US006375309B1

(12) United States Patent
Taneya et al.

(10) Patent No.: US 6,375,309 B1
(45) Date of Patent: Apr. 23, 2002

(54) LIQUID DISCHARGE APPARATUS AND METHOD FOR SEQUENTIALLY DRIVING MULTIPLE ELECTROTHERMAL CONVERTING MEMBERS

(75) Inventors: Yoichi Taneya, Yokohama; Hiroyuki Ishinaga, Tokyo; Hiroshi Tajika; Noribumi Koitabashi, both of Yokohama; Hiroyuki Sugiyama, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/123,811

(22) Filed: Jul. 28, 1998

(30) Foreign Application Priority Data

Jul. 31, 1997 (JP) ..... 9-206549
Sep. 18, 1997 (JP) ..... 9-253532
Sep. 26, 1997 (JP) ..... 9-262346

(51) Int. Cl.[7] ..... B41J 2/14; B41J 2/05
(52) U.S. Cl. ..... 347/48; 347/57
(58) Field of Search ..... 347/48, 65, 57, 347/10, 11, 15, 60, 63

(56) References Cited

U.S. PATENT DOCUMENTS 4,251,824 A * 2/1981 Hara et al. ..... 347/57
4,313,124 A 1/1982 Hara ..... 347/57

(List continued on next page.)

FOREIGN PATENT DOCUMENTS

DE 29 45 658 5/1980
EP 0 317 171 5/1989
EP 0 719 647 7/1996
EP 0 737 586 10/1996
GB 2 292 117 2/1996
JP 54-56847 5/1979
JP 55-132259 10/1980
JP 59-123670 7/1984
JP 59-138461 8/1984
JP 60-71260 4/1985
JP 61-59911 3/1986
JP 61-59914 3/1986
JP 8-169116 7/1986
JP 8-183180 7/1986
JP 62-48585 3/1987
JP 62-240558 10/1987
JP 6-027548 2/1994

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge method for discharging liquid by use of a liquid discharge head provided with liquid discharge nozzles having a plurality of electrothermal converting members capable of forming bubbles for discharging a liquid droplets comprises the step of using a driving condition in a range where the discharge speed of droplets is made substantially constant, while the amount of droplet is made changeable with the timing difference of driving when droplets are discharged by driving a plurality of the electrothermal converting members one after another. With the adoption of the method thus structured, high quality prints can be obtained without deviation of impact positions irrespective of the dot diameters, larger or smaller, for a significant enhancement of image representation.

50 Claims, 24 Drawing Sheets

U.S. PATENT DOCUMENTS

| | | | | | |
|---|---|---|---|---|---|
| 4,345,262 | A | | 8/1982 | Shirato et al. | 347/56 |
| 4,459,600 | A | | 7/1984 | Sato et al. | 347/47 |
| 4,463,359 | A | | 7/1984 | Ayata et al. | 347/56 |
| 4,503,444 | A | * | 3/1985 | Tacklind | 347/11 |
| 4,513,299 | A | | 4/1985 | Lee et al. | 347/15 |
| 4,558,333 | A | | 12/1985 | Sugitani et al. | 347/65 |
| 4,608,577 | A | | 8/1986 | Hori | 347/66 |
| 4,672,398 | A | | 6/1987 | Kuwabara et al. | 347/48 |
| 4,723,129 | A | | 2/1988 | Endo et al. | 347/56 |
| 4,740,796 | A | | 4/1988 | Endo et al. | 347/56 |
| 4,963,883 | A | * | 10/1990 | Matsui | 347/48 |
| 5,166,699 | A | | 11/1992 | Yano et al. | 347/17 |
| 5,367,325 | A | | 11/1994 | Yano et al. | 347/17 |
| 5,625,384 | A | | 4/1997 | Numata et al. | 347/23 |
| 5,731,828 | A | | 3/1998 | Ishinaga et al. | 347/62 |
| 5,754,201 | A | * | 5/1998 | Ishinaga et al. | 347/62 |

* cited by examiner

LIQUID DISCHARGE APPARATUS AND METHOD FOR SEQUENTIALLY DRIVING MULTIPLE ELECTROTHERMAL CONVERTING MEMBERS

BACKGROUND OF THE INVENTION

1. Field of the Invention

The present invention relates to a liquid discharge method and a liquid discharge apparatus.

In this respect, the term "recording" in the description of the present invention means not only the provision of images having characters, graphics, or other meaningful representation, but also, the provision of those images that do not present any particular meaning, such as patterns.

2. Related Background Art

There has been known the so-called bubble jet recording method, which is an ink jet recording method whereby to form images on a recording medium by discharging ink from discharge ports using acting force exerted by the change of states of ink accompanied by the abrupt voluminal changes (creation of bubbles), and to form images on a recording medium by the discharged ink that adheres to it. For the recording apparatus that uses the bubble jet recording method, it is generally practiced to provide, as disclosed in the specifications of Japanese Patent Publication No. 61-59911 and Japanese Patent Publication No. 61-59914, the discharge ports that discharge ink, the ink paths conductively connected to the discharge ports, and heat generating members (electrothermal converting members) arranged in each of the ink paths as means for generating energy for discharging ink.

In accordance with such recording method, it is possible to record high quality images at high speeds with a lesser amount of noises. At the same time, the head that executes this recording method makes it possible to arrange the discharge ports for discharging ink in high density, with the excellent advantage, among many others, that images are made recordable in high resolution, and that color images are easily obtainable by use of a smaller apparatus.

Further, in the specifications of Japanese Patent Laid-Open Application No. 62-48585 and Japanese Patent Laid-Open Application No. 8-169116, there is disclosed a liquid jet recording head provided with energy generating members formed by a plurality of electrothermal converting members arranged in the respective ink flow paths to make it possible to present gradational representation. Also, in the specification of Japanese Patent Laid-Open Application No. 8-183180, a method is disclosed for giving pulses in order to modulate the discharge amounts stably.

However, if it is intended to increase the discharge amount by driving plural electrothermal converting members which are provided together in one ink flow path as in the above conventional example, the discharge speed is also increased at the same time eventually, or if it is intended to decrease the discharge amount, the discharge speed-is decreased simultaneously. Here, the relationship between the discharge amount and the discharge speed is almost proportional. Therefore, when the discharge amount should be decreased, the discharge instability may take place due to the slowdown of the discharge speed. This tendency is more conspicuous under the low temperature environment in particular. In the worst case, there is a fear that the disabled discharge occurs inevitably.

On the other hand, when the discharge amount should be made larger, the discharge speed becomes extremely faster.

As a result, the dot configuration is disturbed on an image or the dot dispersion phenomenon may take place due to the satellite dots to cause the image degradation or the rebounding phenomenon of ink occurs when it is impacted on the surface of a recording sheet. The rebounded ink adheres to the surface of the recording head, hence affecting the stability of liquid discharges in some cases.

SUMMARY OF THE INVENTION

The present invention is designed in consideration of the problems of the conventional techniques of the method for forming discharge liquid droplets by driving a plurality of electrothermal converting members at a time. It is an object of the invention to materialize a discharge method capable of obtaining desired images recorded in higher quality.

It is another object of the invention to provide excellent techniques to overcome the difficulty lying in the technical background to make it possible to specify and obtain the amount of a larger droplet two to three times the amount of a smaller (discharged) droplet even when the smaller droplet is formed by use of one electrothermal converting member, while the larger droplet is formed by use of plural electrothermal converting members for the provision of images in good quality with the droplets having different discharge amounts, larger and smaller as required, respectively.

It is still another object of the invention to provide a discharge method and a recording method capable of forming high quality images by a desired stability of shooting accuracy with the uniform discharge speeds of the methods whereby to make formations different by driving plural electrothermal converting members altogether.

The present inventors hereof have ardently studied every aspect related to the development of an ink jet recording apparatus capable of printing images in higher quality. As a result, giving attention to the flow directivities of liquid (or gas) flow in the directions outgoing and ingoing from the ink flow paths at the liquid discharge ports along with the development and contraction of bubbles by the function of electrothermal converting members, the inventors hereof have made theoretical analyses and found that discharge amounts are made greatly changeable without causing the discharge speeds to vary too much by making the arrangement so that the components formed by the plural electrothermal converting members in the direction (discharging direction) outgoing from the ink flow paths do not intervene to change the discharge speeds themselves, while the components in the direction opposite to the flow direction are allowed to intervene. On the basis of such finding, the inventors hereof have conducted experiments and confirmed that the timing of a first driving pulse and that of a second driving pulse are deviated up to the level of 10 $\mu$sec order which has never been expected in the conventional art. As a result, it has been found that there exists an area where the discharge amount is made changeable, while the ink droplet discharging velocity is substantially constant (a range of timing deviation of 10 $\mu$sec to 20 $\mu$sec, for example).

Hence, the liquid discharge method of the present invention is designed to use a driving condition in a range where the discharge speed of droplets is made substantially constant, while the amount of droplet is made changeable with the timing difference of driving when droplets are discharged by driving a plurality of the electrothermal converting members one after another. These features are shared by the liquid discharge method of the invention that makes the discharge amount changeable.

Also, such timing difference is in a range where the discharge speed of droplets is made substantially constant, and also, the discharge amount is allowed to take the minimum value to the maximum value thereof.

Also, the timing difference is in a range to enable the discharged droplet to be formed as one dot on the surface of the recording medium.

Also, the timing difference is in a range where a second liquid droplet discharged by a second pulse catches up and collides with a first liquid droplet discharged by a first pulse before arriving at the surface of a recording medium, and these droplets are allowed to impact on the surface of the recording medium as one droplet.

Also, such timing difference is characterized in that while the meniscus formed on the discharge port by a first liquid droplet discharged by a first driving pulse is retracted, a second driving pulse is applied.

Also, the waveforms of pulses are different for the first and second pulses.

Also, the energy generating members are arranged in series in the direction of liquid flow in each of the liquid flow paths.

Also, the energy generating members are arranged in parallel with the flow direction of liquid in each of the liquid flow paths.

Also, the feature of the present invention is represented by a liquid discharge method for a liquid discharge head using a nozzle provided with at least two electrothermal converting members (heaters) in the interior thereof for discharging ink from the nozzle by driving the electrothermal converting members in accordance with recording signals for recording one pixel, which comprises the step of discharging ink by setting the timing of driving the other one of the electrothermal converting member subsequent to one of them driven during the period of the meniscus of ink supplied in the nozzle being present in a position retracted from the opening end of the nozzle. During this period, it is possible to make the ink discharge amount changeable without changing the discharge speed too much.

Then, it may be possible to discharge ink by controlling the timing in accordance with the gradational information contained in the recording signals for the formation of pixels having different ink amounts. In this manner, the print quality is stabilized even when the ink discharge amount is controlled in accordance with the gradational information for printing.

Also, the timing is delayed relatively during the period of the meniscus of ink supplied in the nozzle being present in the position retracted from the opening edge of the nozzle for the formation of pixels having a larger amount of ink. In this manner, while suppressing the discharge speed lower, the ink discharge amount can be increased.

It is preferable to arrange the electrothermal converting member driven earlier on the opening edge side of the nozzle, and the electrothermal converting member driven later on the rear side of the nozzle.

It is preferable that the electrothermal converting member driven earlier is comparatively smaller, and the electrothermal converting member driven later is comparatively larger.

Also, the feature of the present invention is represented by a liquid discharge method for a liquid discharge head using a nozzle provided with at least two electrothermal converting members in the interior thereof for discharging ink from the nozzle by driving the electrothermal converting members in accordance with recording signals for recording one pixel, which comprises the steps of forming pixel having a smaller amount of ink by driving only one of electrothermal converting members in the nozzle to discharge ink; and forming pixel having a larger amount of ink by driving one of the two electrothermal converting members in the nozzle, and after that, driving the other one of the electrothermal converting members to discharge ink for the formation of pixel having a large amount of ink by the timing set during the period of the meniscus of ink supplied in the nozzle being present in the position retracted from the opening edge of the nozzle. In this way, it becomes possible to effectively perform printing for the formation of pixels having a smaller amount of ink and those having a larger amount of ink, thus stabilizing the print quality.

Also, the feature of the present invention lies in the provision of a liquid discharge method for a liquid discharge head using a nozzle provided with at least two electrothermal converting members in the interior thereof for discharging ink from the nozzle by driving the electrothermal converting members in accordance with recording signals for recording one pixel, which comprises the step of driving one of the electrothermal converting members when recording one pixel, and driving the other one of the electrothermal converting members subsequent to the one of them being driven at the timing making the ink discharge amount minimum substantially.

Also, another feature of the present invention is represented by a liquid discharge method for a liquid discharge head using a nozzle provided with at least two electrothermal converting members in the interior thereof for discharging ink from the nozzle by driving the electrothermal converting members in accordance with recording signals for recording one pixel, which comprises the step of driving one of the electrothermal converting members when recording one pixel, and driving the other one of the electrothermal converting members subsequent to the one of them being driven at the timing to create bubble in ink by driving of the other one of the electrothermal converting members when the volume of the bubble created in ink by the driving of the one of the electrothermal converting members becomes maximum substantially.

Here, in either cases, the electrothermal converting members are arranged in positions having different distances from the opening edge of the nozzle, respectively.

Also, in some cases, the electrothermal converting member having the shorter distance from the opening edge is driven earlier, and after that, the electrothermal converting member having the longer distance from the opening edge is driven at such timing, and vice versa.

Also, the electrothermal converting member having the shorter distance from the opening edge has a smaller area than the electrothermal converting member having the longer distance from the opening edge in some case.

Also, in some other case, the areas of the electrothermal converting member having the shorter distance from the opening edge and the electrothermal converting member having the longer distance from the opening edge are the same.

It is preferable to arrange so that the electrothermal converting member having the shorter distance from the opening edge is provided with an area for the value of discharge speed v/discharge amount Vd of the individual ink discharge from the electrothermal converting member to be reduced as the distance is increased.

DETAILED DESCRIPTION OF THE PREFERRED EMBODIMENTS

Figure 1A:
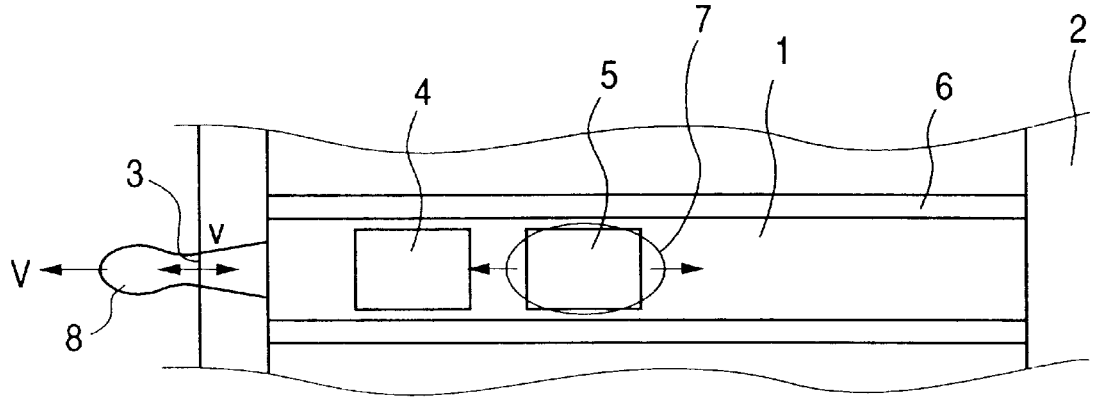
FIGS. 1A and 1B are plan views which illustrate the structure of the flow paths and the plural heaters used for the present invention.
Figure 1B:
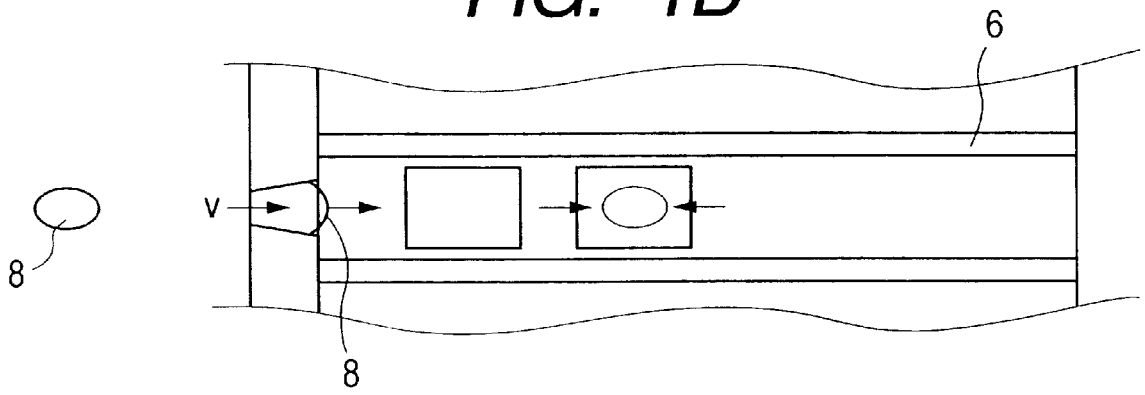
Figure 2A:
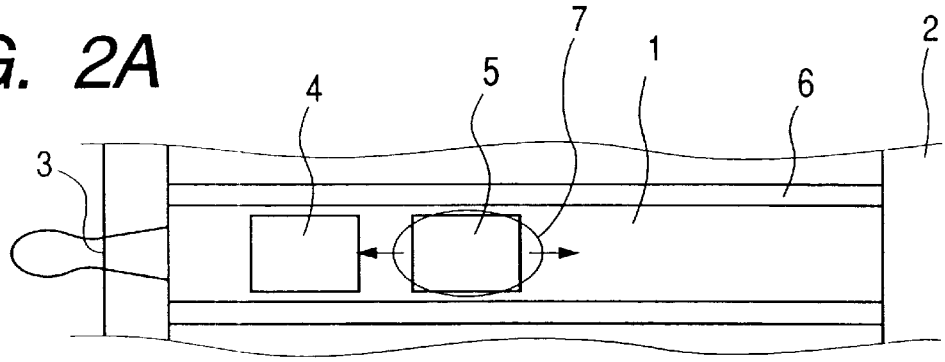
FIGS. 2A, 2B, 2C, and 2D are views which illustrate the state of driving with different timing the first heater 5 and the second heater 4 provided for the flow path 1 of the liquid discharge head represented in FIGS. 1A and 1B.
Figure 2B:
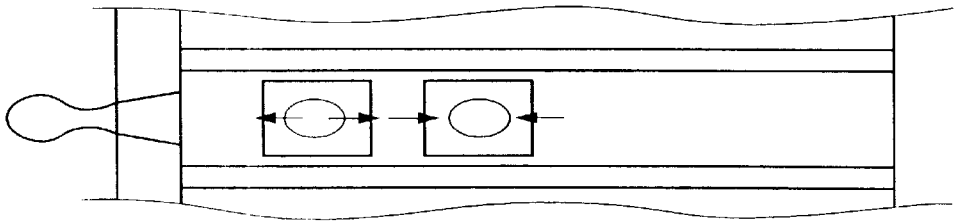
Figure 2C:
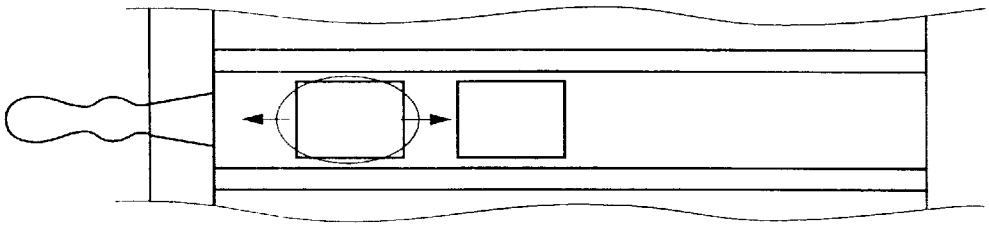
Figure 2D:
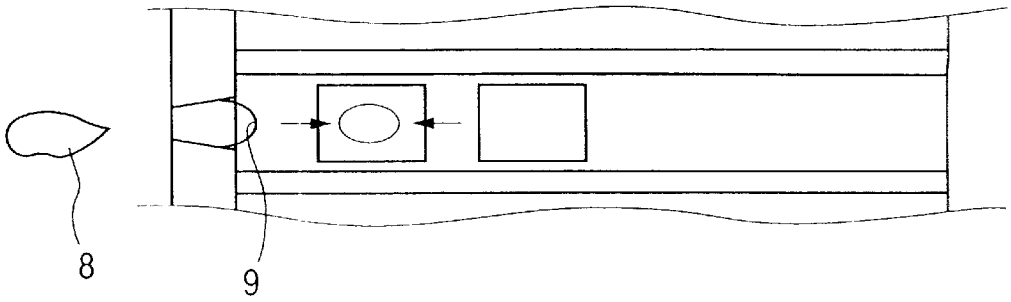

Now, with reference to the accompanying drawings, the description will be made of the embodiments in accordance with the present invention FIGS. 1A and 1B are plan views which illustrate the structure of a liquid flow path and plural heaters (FIGS. 1A and 1B contain the case where the plural heaters are provided with different areas or different resistance, respectively). For the liquid jet recording head of the present embodiment, which is the one having multiple nozzles, a plurality of flow paths 1 are formed, each being separated by the flow path walls 6, and as means for generating energy for discharging liquid, a first heater (electrothermal converting member) 5 and a second heater 4 are provided in each of the flow paths. Then, by energizing either one of them or both of them, liquid in each of the flow paths is heated and discharged from plural discharge ports 3 arranged for each of the flow paths. The discharging liquid is supplied from a common liquid chamber 2 to each of the flow paths 1, and discharged from the corresponding discharge port 3. However, the first heater 5 and the second heater 4 are arranged in that order in the flow direction in flow path 1.

Now, in conjunction with FIGS. 1A and 1B and FIG. 3, the description will be made, at first, of the relationship between the creation of the bubble 7 by means of the heater 5 and the flow speed v of the liquid flow (or the atmospheric current when the meniscus 9 draws it) in the discharge port 3 that determines the speed V of the discharge liquid droplet 8. For the present embodiment, the multiple nozzle is adopted, which is formed by a plurality of nozzles as one body. In FIGS. 1A and 1B, plural discharge ports are represented for one liquid jet recording head.

Now, one heater 5 is used for the description herein, among those referred to in the preceding paragraph. In the description given below, the discharge ports positioned above are represented by the one shown in FIG. 1A, and those positioned below are represented by the one shown in FIG. 1B in order to make the operation easily understandable.

FIG. 1A shows the state where a bubble is created by use of the discharge heater 5 and it is in the development. FIG. 1B shows the contracting process after the bubble has been developed to the maximum.

Figure 3:
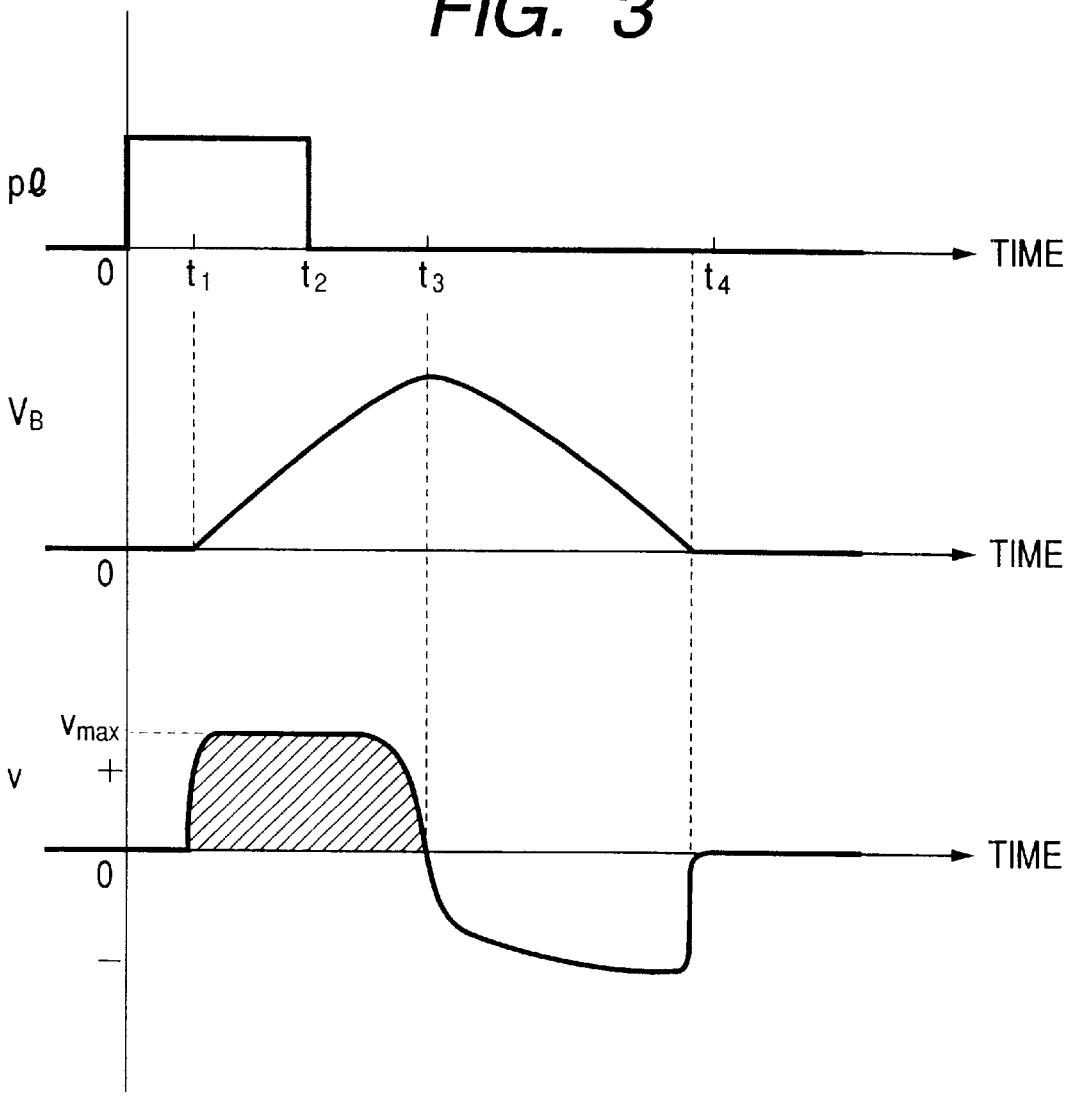
FIG. 3 is a view which shows the relationship between the current pulse PI, the bubbling volume $V_B$, and the flow speed v where the pulse current applied to the first heater 5 shown in FIGS. 1A and 1B is given as PI; the bubbling volume is given as $V_B$ for the liquid which is heated to bubble on the bubble generating area above the first heater 5 subsequent to the first heater 5 having been heated; the flow speed at the discharge port 3 is given as v; and the discharge direction is defined as positive, while the direction of liquid flow path 1 as negative.

In FIG. 3, the applied pulse current to the first heater is given as PI. Then, by this current, the first heater is heated. The bubbling volume is given as $V_B$ when the liquid is heated to bubble in the bubble generating area on the first heater 5. The flow speed at the discharge port 3 is given as v. The discharge direction is given as positive. The liquid flow path 1 direction is given as negative. With these definitions, the relationship between the electric current pulse PI, the bubbling volume $V_B$ and the flow speed v is represented.

With the time 0, the pulse current PI is applied to the first discharge heater. Then, after several μsec, the bubble 7 is created at time $t_1$. The bubbling volume $V_B$ begins to be increased. At this juncture, the flow speed (here, liquid flow) becomes the one indicated by the v.

After the time $t_3$ has elapsed, the bubble 7 begins to be contracted. At this juncture, the flow speed v becomes the component in the negative direction as shown in FIG. 3. Here, the relationship between the positive and negative components is obtainable by the following formula:

$$\left|\int_{t_1}^{t_3} v(t)dt\right| = \left|\int_{t_3}^{t_4} v(t)dt\right|$$

Also, the speed V of the discharged droplet 8 becomes the average of the positive components of the v, it is expressed as follows:

$$V = \frac{\int_{t_1}^{t_3} v(t)dt}{t_3 - t_1}$$

Also, given the discharge port 3 as $s_0$, the discharge amount Vd at this juncture is theoretically expressed as given below (that is, the area indicated by slanted lines is multiplied by $S_0$).

$$Vd = S_0 \times V = S_0 \times \int_{t_1}^{t_3} v(t)dt$$

FIGS. 2A to 2D are views which illustrate the state where the first heater 5 and the second heater 4, which are arranged in the liquid flow path 1 of the liquid discharge head represented in FIGS. 1A and 1B, are driven with different timing. In order to make the operation easily understandable, the description will be made of the discharge ports positioned above and below in that order sequentially in accordance with FIGS. 2A to 2D.

Figure 4:
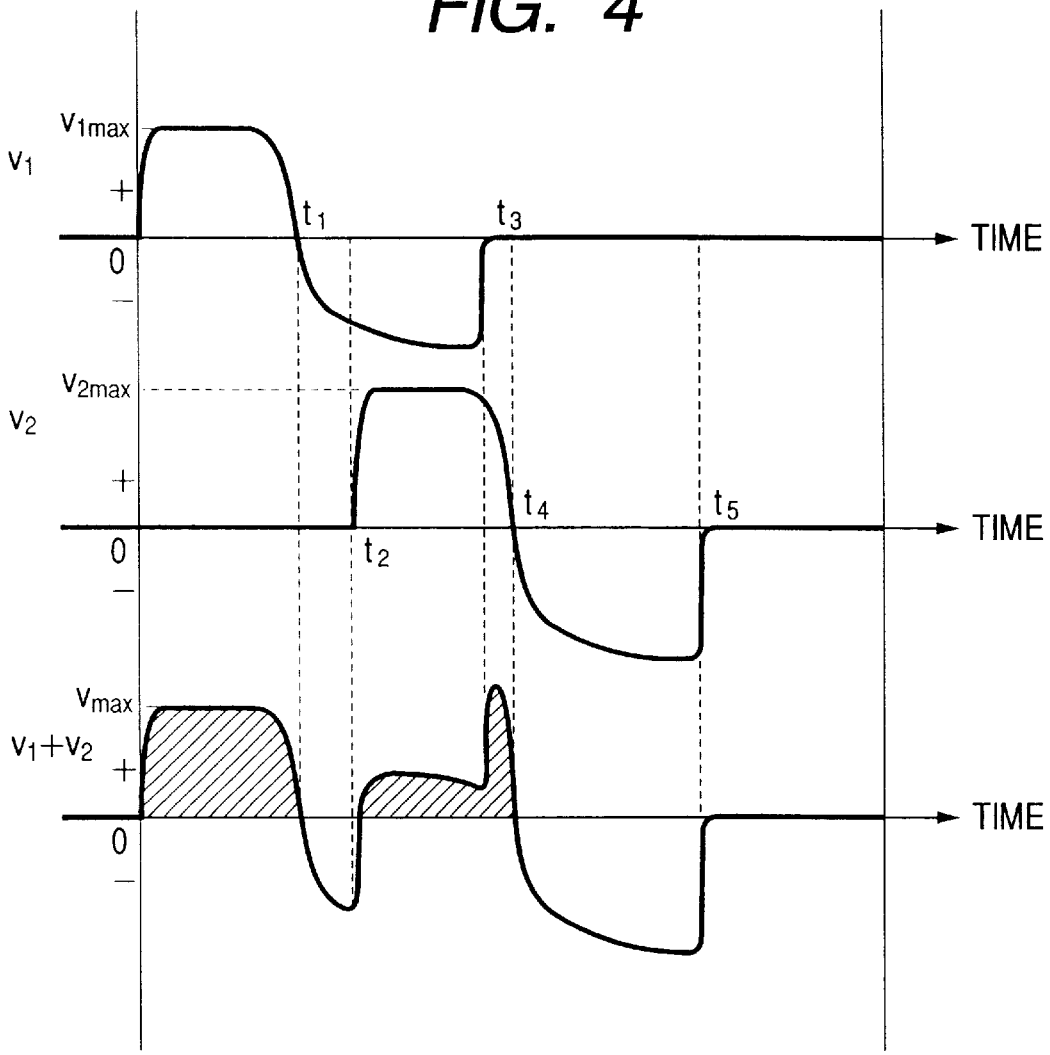
FIG. 4 is a view which shows the flow speed when driving each of the heaters represented in FIGS. 1A and 1B, where the flow speed v of the first heater 5 is given as $v_1$, and the flow speed v of the second heater 4 is given as $v_2$.

FIG. 4 is a view which shows the flow speed at the time of driving each heater. The flow speed v of the first heater 5 is given as $v_1$, and the flow speed v of the second heater 4 is given as $v_2$.

In the state shown in FIGS. 2A to 2D, it is arranged that the first heater 5 is driven to bubble at the time 0, and the second heater 4 at the time $t_2$. However, at the time $t_2$, the component of the first heater is made negative. Therefore, the flow speed v becomes rather small. Also, at the time $t_3$ to $t_4$, since the flow speed $v_1$ component of the first heater 5 is 0, the positive component of the flow speed $v_2$ is generated. The resultant average speed V becomes the mean value of the portion indicated by slanted lines in FIG. 4 as follows:

$$V = \frac{\int_0^{t_1} v_1(t)dt}{t_1} + \frac{\int_{t_2}^{t_4} \{v_1(t) + v_2(t)\}dt}{t_4 - t_2}$$

Therefore, if the bubbling timing $t_2$ of the second heater is subsequent to the time 0 to $t_1$ for the bubble development by the first heater 5, the average speed V is not made extremely large. As a result, the changing ratio of the average speed V is small even if the discharge amount is changed. Also, the state of the discharge liquid droplet 8 is deformed in accordance with the average speed V. However, it becomes substantially sphere due to the surface tension of the liquid during its flight. Also, the droplet may be broken into plural pieces in some cases, but there occurs no problem as to the image to be formed on the surface of a recording medium if only the driving is made in condition that the droplet is arranged to form one dot.

(Embodiment 1)

Figure 5A:
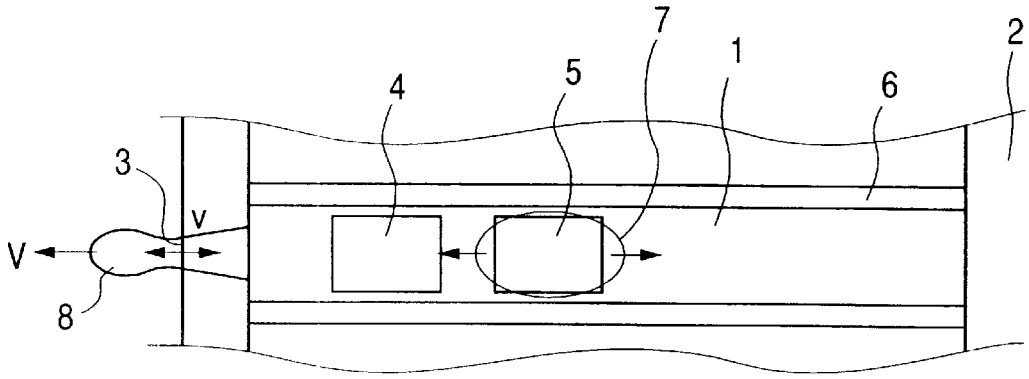
FIGS. 5A and 5B are plan views which illustrate the structure of the interior of the liquid flow path of a liquid jet recording head in accordance with a first embodiment of the present invention.
Figure 5B:
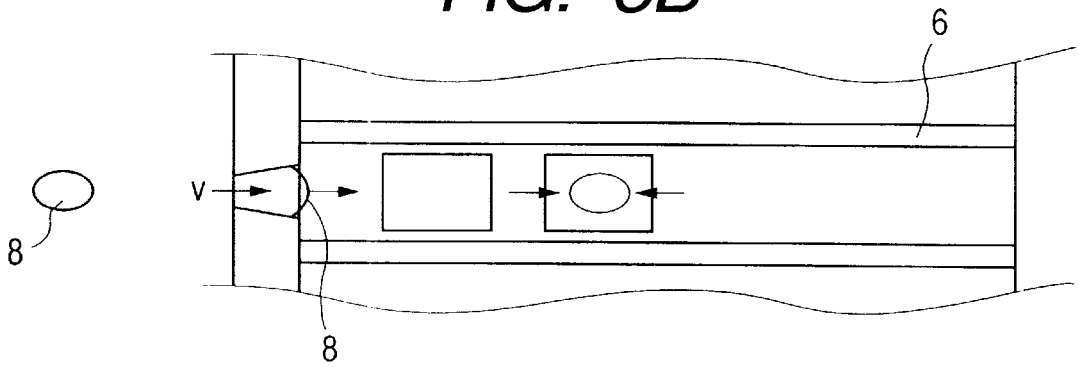

FIGS. 5A and 5B are plan views which illustrate the structure of the interior of the liquid flow path of a liquid jet recording head in accordance with a first embodiment in accordance with the present invention. The present embodiment has the same structure as the liquid jet recording head shown in FIGS. 1A and 1B and FIGS. 2A to 2D. The areas of the first heater 5 and the second heater 4 are the same, and arranged in series in the direction of liquid flow in the liquid flow path 1. Therefore, the same reference marks as those used in FIGS. 1A and 1B and FIGS. 2A to 2D are also used for FIGS. 5A and 5B.

Figure 6:
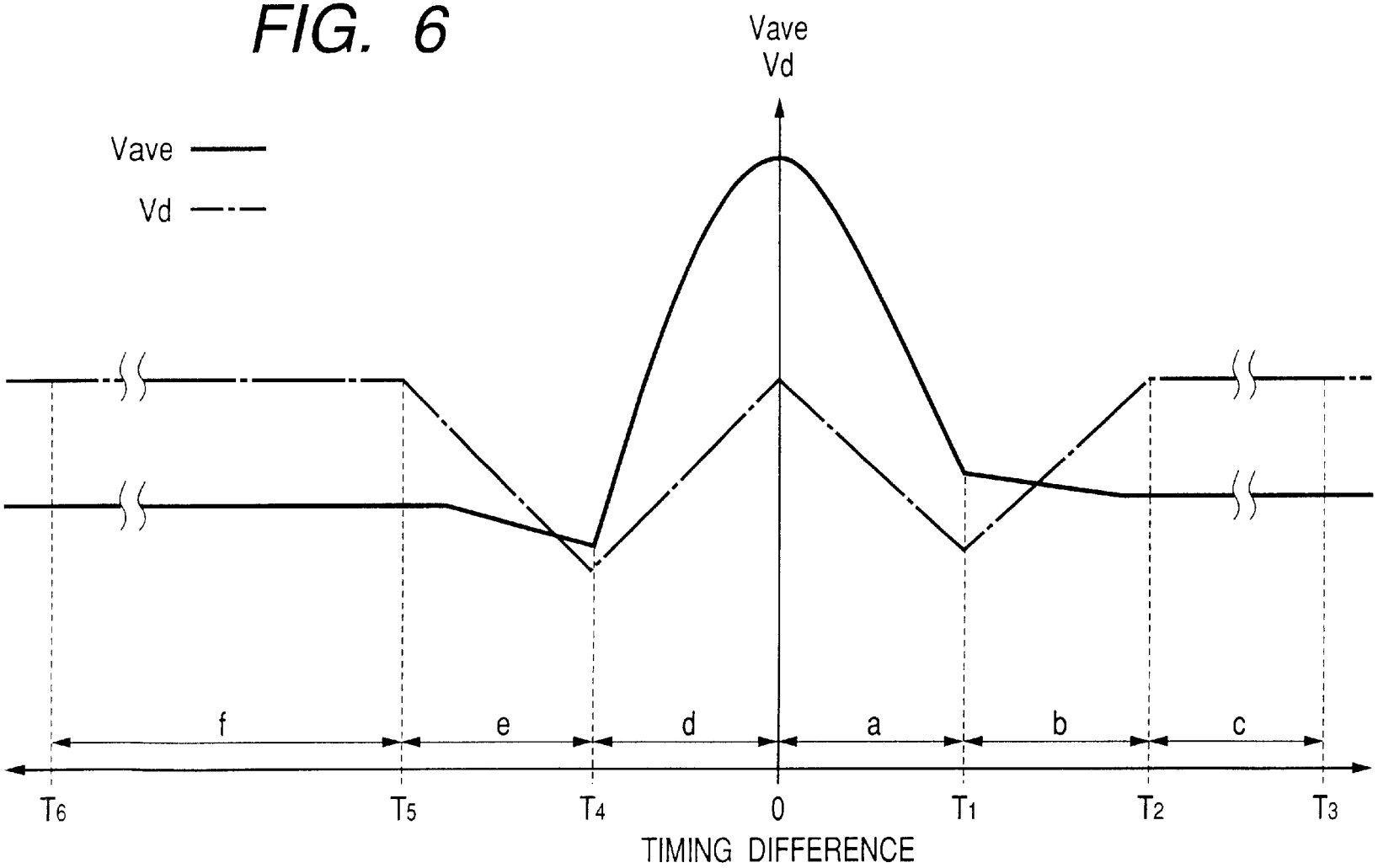
FIG. 6 is a graph which schematically shows the discharge speed Vave and the discharge amount Vd of the discharge liquid discharged by the liquid jet recording head and the discharge method of the present invention by use of the solid and dashed lines, respectively.

FIG. 6 is a graph which schematically shows the discharge speed Vave and the discharge amount Vd of the discharge liquid discharged by the liquid jet recording head and the discharge method of the present invention. Here, by use of the solid and dashed lines, these are indicated, respectively. In FIG. 6, the axis of abscissa indicates the difference T between the driving timing of the first heater 5 and the second heater 4. With respect to the timing at which to give the driving pulse for the supply of pulse current is applied to the first heater 5, the timing of the driving pulse application to the second heater 4 is defined as the positive side when the driving pulse is applied later. On the contrary, it is defined as the negative side when the driving pulse is applied to the second heater earlier than the timing difference 0.

Also, the driving pulse applied to the first heater 5 is given as a first pulse, and the driving pulse applied to the second heater 4 is given as a second pulse. In the area a (the timing difference is 0 to $T_1$), if the timing difference is made larger for the timing of driving pulse application, the discharge amount is gradually decreased, and at the same time, the discharge speed is made slower significantly. This corresponds to the time $0 \leqq t_2 \leqq t_1$ in FIG. 4. Further, if the timing difference of the driving pulse application is largely deviated, the discharge amount indicates its minimum value at a predetermined timing $T_1$. Then, the discharge amount is gradually increased, and the discharge speed is substantially in a constant area b. The time $T_1$ at which the discharge amount indicates its minimum value is the timing that makes $t_1 \cong t_2$ in FIG. 4.

In the area b, the first liquid droplet which has been discharged by the first pulse, and the second liquid droplet which has been discharged by the second pulse are discharged in a continuous mode. This mode is preferable, because when these droplets are impacted on a recording medium, the dot configuration becomes substantially circular. If the timing of the driving pulse application is deviated larger still in the area b ($T_1$ to $T_2$), the discharge amount indicates its maximum value substantially at a predetermined timing difference $T_2$. After that, even if the timing is largely deviated, the discharge amount is no longer increased, that is, the timing difference arrives at the area c ($T_2$ to $T_3$).

In the area c, which is at $t_3$ and $t_2$ in FIG. 4, the timing of the driving pulse application is deviated largely. As a result, the first and second liquid droplets are discharged in such a manner that the main portion of the second liquid droplet discharged by the second pulse is continuous to the trailing end of the first liquid droplet discharged by the first pulse or the first liquid droplet and second liquid droplet are discharged individuallly in succession.

When the first and second liquid droplets are discharged in the continuous mode, the dot configuration becomes almost circular in the area b, hence obtaining images in higher quality. Further, even if the first and second liquid droplets discharged separately in continuation, there is no problem as to the image formation if only the resultant impact positions are not greatly deviated on the surface of the recording medium when a liquid jet recording apparatus is structured and used as described later.

In the area d ($T_4$ to 0), if the timing of the driving pulse application is made larger, the discharge amount is gradually decreased, and at the same time, the discharge speed is made slower significantly. When the timing of the driving pulse application is largely deviated, the discharge amount indicates its minimum value at a predetermined timing difference $T_4$. Then, the discharge amount is gradually increased, while the discharge speed arrives at the area e where it becomes substantially constant.

In the area e ($T_4$ to $T_5$), the second liquid droplet which has been discharged by the second pulse, and the first liquid droplet which has been discharged by the first pulse are discharged in a continuous mode. If the timing of the driving pulse application is deviated larger still in the area e, the discharge amount indicates its maximum value substantially at a predetermined timing difference $T_5$. After that, even if the timing is largely deviated, the discharge amount is no longer increased, that is, the timing difference arrives at the area f ($T_5$ to $T_6$).

In the area f, since the timing of driving pulse application is largely deviated, the main portion of the first liquid droplet discharged by the first pulse is discharged to the trailing portion of the second liquid droplet discharged by the second pulse in the continuous mode or the second and first liquid droplets are discharged separately in continuation.

In the area a and the area d, if the discharge amounts are modulated for the gradational representation, there is automatically a limit to the practical design area where the discharge speed of the liquid droplets is greatly changed inevitably. For the present invention, however, it is possible to implement the individual use of the first heater 5 with its minimum discharge amount. As a result, if the discharge amount should be increased, the area b may be used. In this manner, it is possible to make the discharge amount Vd variable, while maintaining the constant level of the flow speed v.

In this case, since the discharge speed does not change even when the modulation is made, the heater which should be driven earlier can be driven faster to the extent that the timing is deviated. In this way, within a range where one dot is formed by the discharged droplet on the surface of a recording medium, the gradation becomes richer, hence making it possible to obtain images printed in higher quality.

(Embodiment 2)

Figure 7:
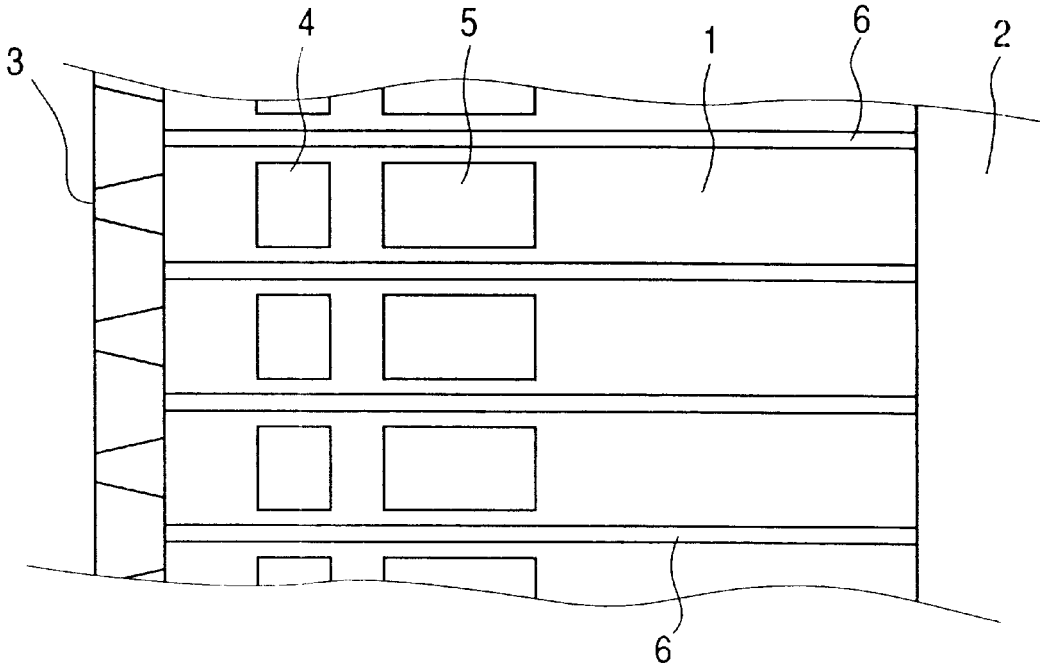
FIG. 7 is a plan view which shows the structure of the interior of the liquid flow path of a liquid jet recording head in accordance with a second embodiment of the present invention.

FIG. 7 is a plan view which shows the structure of the interior of the liquid flow path of a liquid jet recording head in accordance with a second embodiment of the present invention. The liquid flow path 1, the common liquid chamber 2, the discharge port 3, the second heater 4, the first heater 5, and the flow path walls 6 are the same as the liquid flow path 1, the common liquid chamber 2, the discharge port 3, the second heater 4, and the first heater 5, and the flow path walls 6 shown in FIGS. 1A and 1B, and FIGS. 5A and 5B. However, the areas of the first heater 5 and the second heater 4 used for the present embodiment are made 2:1. These heaters are arranged in series in the liquid flow path 1.

Figure 8:
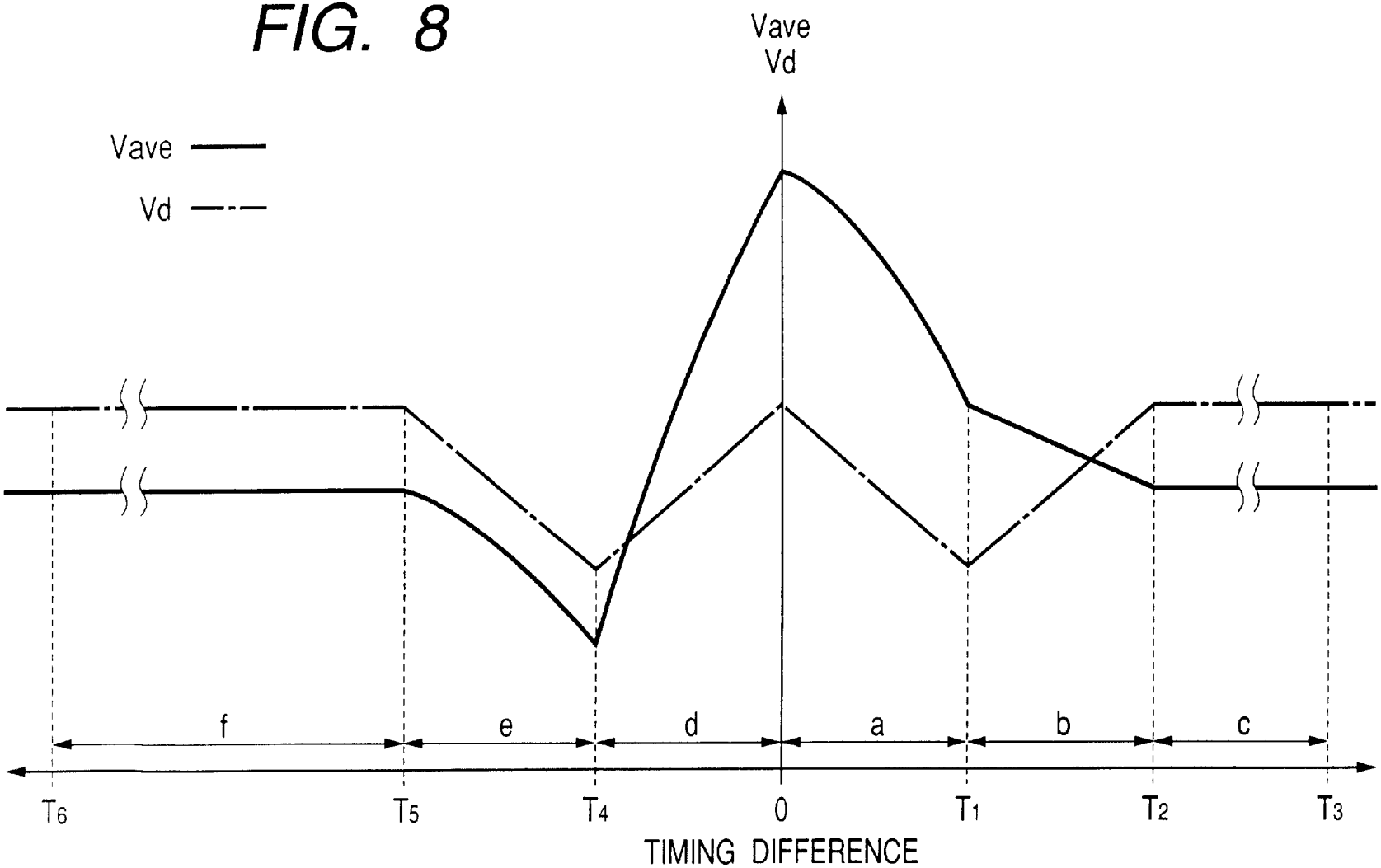
FIG. 8 is a graph which schematically shows the discharge speed Vave and the discharge amount Vd of the discharge liquid discharged by the liquid jet recording head and the discharge method in accordance with the second embodiment of the present invention.

FIG. 8 is a graph which schematically shows the discharge speed Vave and the discharge amount Vd of the liquid droplet discharged by the liquid jet recording head and the discharge method of the present invention. The standard of the time T represented on the axis of abscissa is defined as 0 when setting the timing of the driving pulse application to the first heater 5, and defined as the negative side when the timing of the driving pulse application to the second heater 4 is later than this time, and on the contrary, it is defined as the positive side when the driving pulse is applied to the second heater 4 earlier. Also, the driving pulse applied to the first heater 5 is given as a first pulse, and the driving pulse applied to the second heater 4 is given as a second pulse.

For the present embodiment, the discharge amount Vd and the discharge speed Vave of the liquid jet recording head do not present any axisymmetrical graph centering on the axis Y. In the area a, if the timing of the driving pulse application is made larger, the discharge amount is gradually decreased, and at the same time, the discharge speed is made slower significantly. Then, if the timing of the driving pulse application is deviated larger still, the discharge amount Vd indicates its minimum value at a predetermined timing $T_1$. Then, the discharge amount Vd is gradually increased, and the discharge speed Vave is substantially in a constant area b.

In the area b, the first discharge liquid droplet which has been discharged by the first pulse, and the second discharge liquid droplet which has been discharged by the second pulse are discharged in a continuous mode. This mode is preferable, because when a these droplets are impacted on a recording medium, the dot configuration becomes substantially circular.

In the area b, if the timing of the driving pulse application is largely deviated, the discharge amount Vd indicates its maximum value substantially at a predetermined timing different $T_2$. After that, the discharge amount is no longer increased even if the timing is deviated larger still, that is, it arrives at the area c.

In the area c, the timing of the driving pulse application is deviated largely. As a result, the first and second liquid droplets are discharged in such a manner that the main portion of the second liquid droplet discharged by the second pulse is continuous to the trailing end of the first liquid droplet discharged by the first pulse in the continuous mode or the first liquid droplet and second liquid droplet are discharged individually in succession.

Here, the bubbling power of the second heater 4 itself is smaller than that of the first heater 5 in accordance with the present embodiment. Also, since the second heater is positioned closer to the discharge port 3 than the first heater 5, the energy that forms the discharge liquid droplet is smaller than that of the first heater 5. As a result, the speed of formed discharge droplet is also smaller than the discharge liquid droplet formed by the first heater 5. In this manner, when a liquid jet recording apparatus is structured as described later, the second discharge liquid droplet whose discharge speed is larger than the first discharge liquid droplet may catch up with the first discharge liquid droplet on the way even if the first discharge liquid droplet and the second discharge liquid droplet are discharged separately in continuation in the area c, provided that the distance between them comparatively closer to each other. Therefore, these droplets become one droplet before arriving at a recording medium.

In the area d, if the timing of the driving pulse application is made larger, the discharge amount Vd is gradually decreased, and at the same time, the discharge speed Vave is made slower significantly. When the timing of the driving pulse application is largely deviated, the discharge amount indicates its minimum value at a predetermined timing difference $T_4$. Then, the discharge amount Vd is gradually increased, while the discharge speed Vave arrives at the area e where it becomes higher gradually.

In the area e, the second discharged droplet which has been discharged by the second pulse, and the first liquid droplet which has been discharged by the first pulse are discharged in a continuous mode.

In the area f, since the timing of the driving pulse application is largely deviated the first and second liquid droplets are discharged in such a manner that, the main portion of the first liquid droplet discharged by the first pulse is continuous to the trailing portion of the second liquid droplet discharged by the second pulse in the continuous mode or the second and first liquid droplets are discharged individually in succession. However, in the area f, the discharge speed of the second discharge liquid droplet is higher than that of the first discharge liquid droplet. As a result, unlike in the area c, these two droplets cannot be made as one discharge liquid droplet.

In the area a and the area d, if the discharge amounts are modulated for the gradational representation, the discharge speed of the liquid droplets is greatly changed inevitably, and the impact positions of the discharge liquid droplets whose dot diameters are different are deviated eventually, causing the difficulty in improving the image quality. Also, because droplets are discharged-in two kinds of discharge amount from one nozzle, the discharge speed is extremely slow at the minimum discharge amount when the first heater 5 and the second heater 4 are driven individually. As a result, not only the impact positions are extremely deviated, but also, twisting and disabled discharge tend to occur, thus the image quality being often subjected to degradation. However, in the area b and area e, the discharge speeds do not change greatly even if the discharge amounts are modulated. Thus, it is made possible to print high quality images having rich gradation within a range where one dot is formed by the discharged droplets on the surface of a recording medium if only the heater that should be driven earlier is driven faster to the extent that the timing is deviated.

For each of the above embodiments, no particular description has been made of the driving pulses for supplying the pulse current to each of the heaters, but it is assumed that the same driving pulses are applied to each of the heaters for the operation of each embodiment. Here, however, the amount of droplets to be discharged and the speed thereof become different as a matter of course if the configuration of driving pulses, that is, its width and height, are made different or if a plurality of driving pulses are applied within an extremely shorter period of time.

On the other hand, for the first embodiment and the second embodiment, the amount of droplets to be discharged and the speed thereof are different depending on the ratio of the heater areas, and the sizes thereof as indicated by the fact that the relationship between the discharge speeds and the discharge amounts becomes different. The size, configuration, and arrangement of each of the heaters are fixed. Therefore, by making the above-mentioned driving pulses different, it becomes possible to apply those shown in the first embodiment to the operation of the second embodiment, and vice versa. Then, the arrangement may be made so that the configuration of driving pulse applied to each of the heaters is made changeable per heater.

(Third Embodiment)

With respect to the timing of the second pulse application, it is desirable to apply the second pulse during the period when the meniscus, which is formed on the discharge port by the first liquid droplet discharged by the first pulse, resides on the heater side rather than on the discharge port surface side. This is because the amount of droplet discharged by the creation of bubble becomes greater when the distance between the bubble and the meniscus is shorter. With the timing being set as this, the performance of discharges becomes more effective.

Now, hereunder, with reference to the accompanying drawings, this desirable timing will be described in detail.

Figure 15:
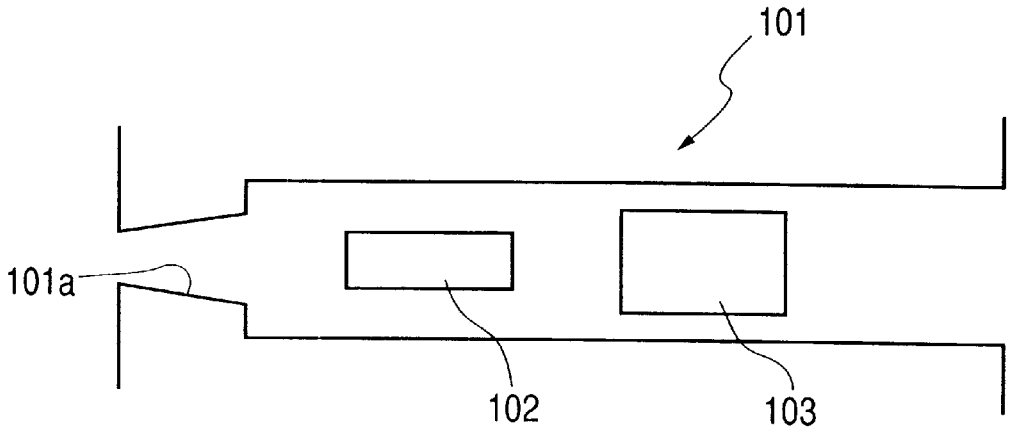
FIG. 15 is a view which schematically shows a nozzle used for the third embodiment in accordance with the present invention.

In FIG. 15, the nozzle PI used for ink discharges is shown. This nozzle is used for a third embodiment in accordance with the present invention. In the interior of this nozzle 101, there is arranged a smaller front side heater 102 on the nozzle opening edge 101*a* side, and a larger rear side heater 103 on the location behind the smaller one. In accordance with the ink jet recording method of the present embodiment, the smaller heater 102 is driven at first. Then, after that, the larger heater 103 is driven by means of the driving circuit (not shown). For the present embodiment, the driving timing of both heaters 102 and 103 is set preferably at equal to or more than 15 $\mu$s with intervals of 15 to 30 $\mu$s. As to this driving timing, the description will be made later.

Figures 16A, 16B, 16C:
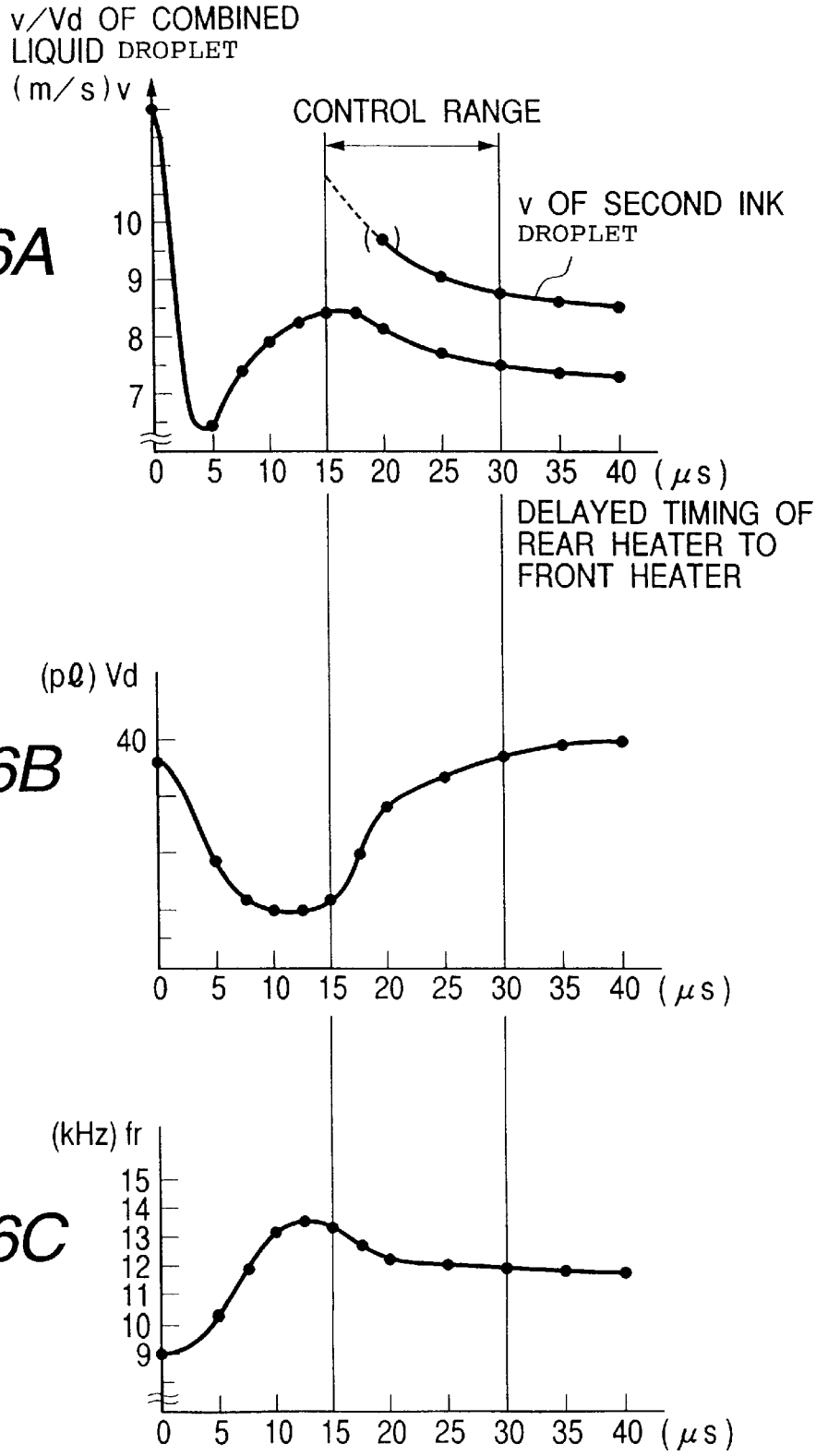
FIG. 16A is a view which shows the relationship between the heater heating timing and the discharge speeds in accordance with the third embodiment of the present invention.
FIG. 16B is a view which shows the relationship between the heater heating timing and the discharge amounts.
FIG. 16C is a view which shows the relationship between the heater heating timing and the printing frequency.
Figures 18A, 18B, 18C:
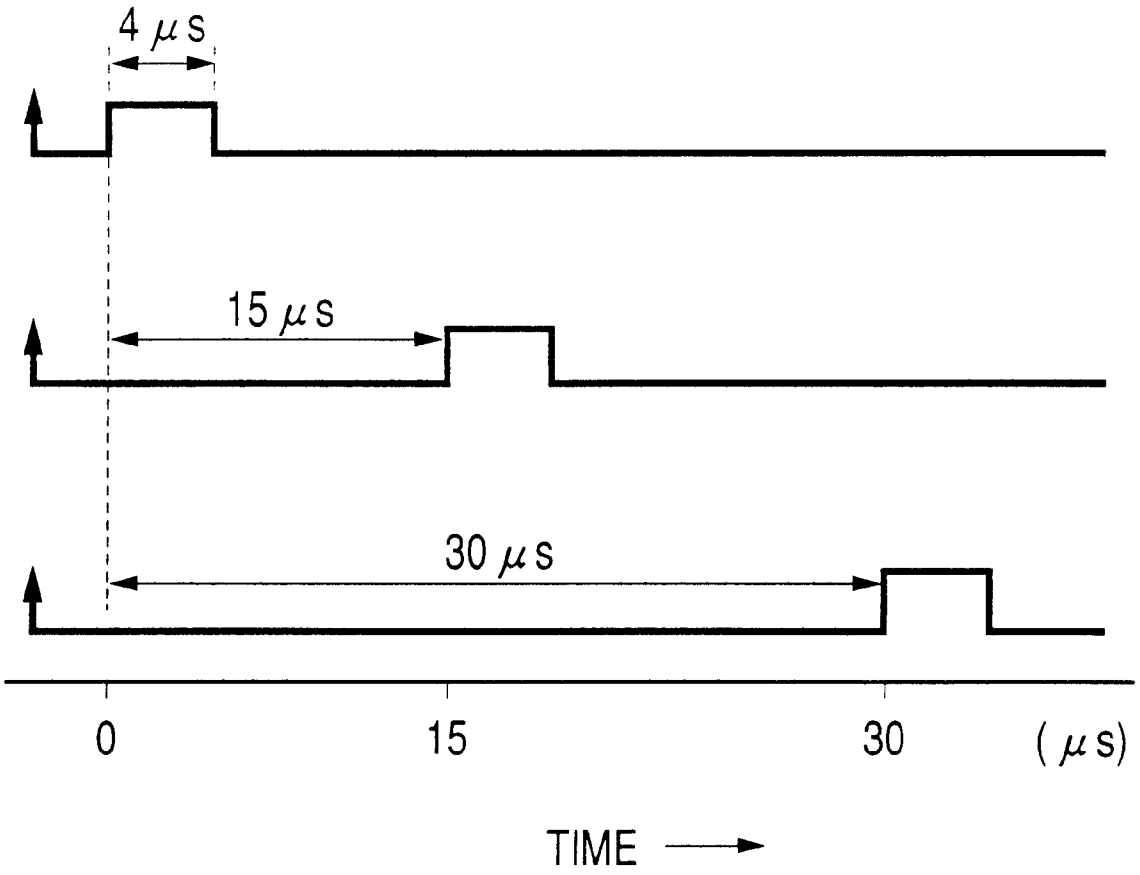
FIGS. 18A, 18B and 18C are timing charts which illustrate timing of the heater driving pulses in accordance with the present invention.

The applicant hereof has measured the discharge speed v, the ink discharge amount Vd, and the driving frequency fr when the driving timing is made changeable for both heaters 102 and 103 variously. The result is shown in FIGS. 16A to 16C. Here, in FIG. 16A, the second ink droplet is indicated by dotted line, which shows the discharge condition where the first ink droplet is not separated from the second ink droplet. In accordance with the result shown in FIGS. 16A to 16C, there is the delay timing (interval) as to the heater 103 which is driven later than the heater 102 which has been driven earlier. If such delay is within a range of approximately 15 $\mu$s or more, the difference is 30 pl between the maximum value and the minimum value of the ink discharge amount Vd. However, the discharge speed v and the driving frequency fr are comparatively high, and the fluctuation width is smaller. Therefore, by setting the timing arbitrarily within this range, it becomes possible to change the ink discharge amounts Vd without varying the discharge speed v and the driving frequency fr too much, that is, without affecting the print quality greatly. It is effective that the ink discharge amounts Vd should be changed within the interval range of approximately 30 μs or less. In this range, the discharge amounts are made changeable considerably. On the other hand, in the range of interval being 0 μs (both heaters 102 and 103 are energized at the same time) to approximately 15 μs, the fluctuation of the discharge speed v and the driving frequency is large. Therefore, the result is almost the same as the conventional example. Here, in the timing chart illustrated in FIGS. 18A to 18C, there is the case where the driving pulse is applied to the heater that should be driven later after 15 μs has elapsed since the application of the driving pulse to the heater that should be driven earlier (see FIG. 18B). There is also the case where the driving pulse is applied to the heater that should be driven later after 30 μs has elapsed (see FIG. 18C). Here, the optimal range lies between these two cases in consideration of the results of measurements conducted by the applicant hereof.

Figure 17:
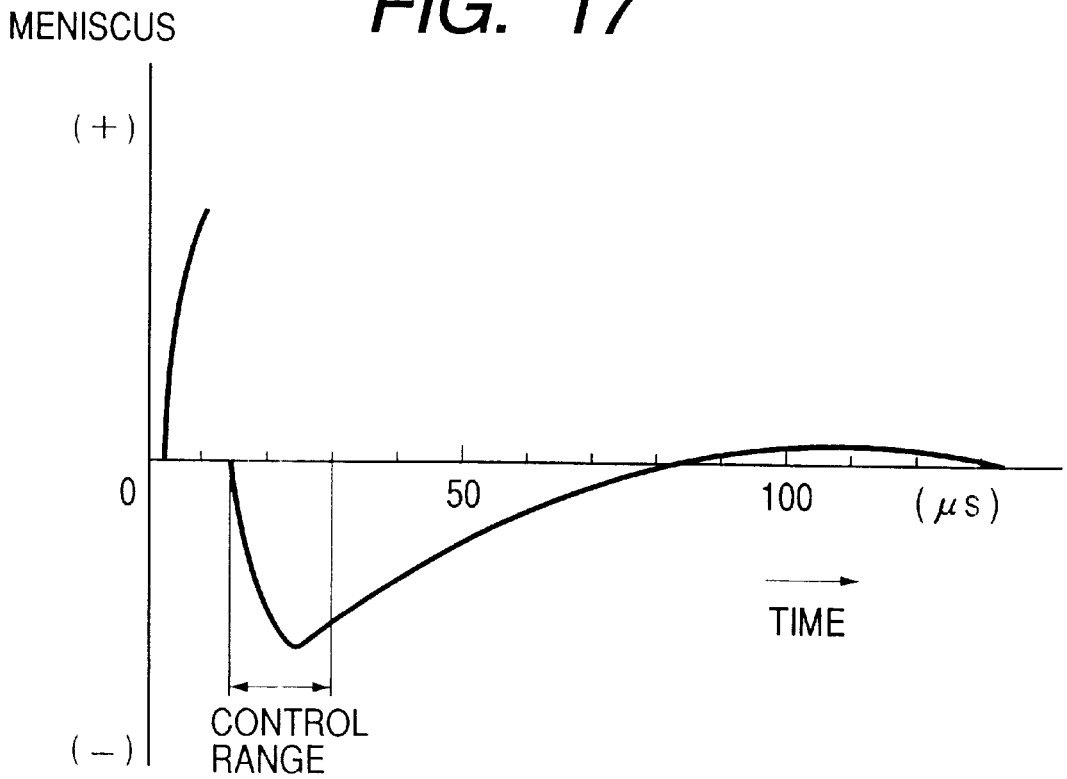
FIG. 17 is a view which shows the relationship between the elapsed time after the heater is driven once and the amount of meniscus fluctuation.

Now, the description will be further made of the required driving timing of both heaters for the demonstration of the effect described above. FIG. 17 is a graph which shows the elapsed time since the front side heater has been driven, and the fluctuation of the ink meniscus on the nozzle opening edge. FIG. 17 shows the result of the observation of the state until the vibration of meniscus is attenuated while the driving of the rear side is at rest. The positive side of the meniscus is the amount thereof that expands externally from the discharge port edge, while the negative side is the amount thereof that retracts to the inner side of the discharge port edge portion.

Here, in accordance with the present invention, the meniscus means the stabilization point of the gas liquid interface in the discharge port portion. Since the stabilization point is the tip of the ink liquid column immediately after ink has been discharged (0 to 10 μs), this point is adopted and represented as such interface for the convenience' sake. As a result, the meniscus is positioned on the positive side immediately after the ink discharge. After that, as the bubble is being contracted, the liquid column is constricted in the vicinity of the discharge port. Then, one other stabilization point is created at the constricted position. This portion is defined as the meniscus. Here, around 10 to 15 μs range in FIG. 17, a discontinued portion takes place. In other words, for the present invention, the timing at the position where the meniscus has been retracted from the discharge port edge is substantially equal to the timing at which the constriction occurs in the column of the discharged liquid near the discharge port.

As described earlier, the present embodiment produces its effect when the timing difference is 15 μs or more. Here, in accordance with FIG. 17, this effective range lies during the period when the meniscus is on the negative side, that is, when the heater on the rear side is driven, while the meniscus resides on the retracted position from the nozzle opening edge. In this respect, FIG. 17 shows that the meniscus is on the positive side at the timing of 80 μs or more. Here, referring to FIGS. 16A to 16C, it is readily understandable that the discharge amount does not change noticeably at the timing of 30 μs or more, not to mention the range of 80 μs or more, where no essential effect is obtainable as described earlier.

Conceivably, the reasons why the discharge amount varies depending upon the driving timing of the heater are as given below for the present invention. In other words, when the meniscus is caused to retract following the contraction of the bubble which has been developed by the driving of the front heater, the rear heater is driven to perform bubbling. Then, the discharge force of such bubbling is offset by the retracting speed of the meniscus, which makes the discharge amount smaller. If the timing is made slower, the retracting speed of the meniscus is attenuated, thus enabling the discharge amount to increase. After that, the discharge amount is increased more when the meniscus is restored. Here, the changing amount becomes moderate.

Further, in accordance with the present embodiment, when the bubble, which has been developed by the earlier driving of the heater on the front side, is contracted, the flow resistance (inertance) is smaller in front of the heater than the flow resistance in back of the heater when the rear side heater is driven. As a result, the meniscus is retracted greatly. Then, by driving the rear heater when the meniscus is retracted and restored, it becomes possible to modulate the ink discharge amount considerably. Essentially, it is effective to drive the rear heater during the period when the meniscus resides on the retracted position from the nozzle opening edge.

As clear from FIGS. 16A to 16C, if the formation step is set, by the application of the present embodiment, at the timing of approximately 15 μs in order to produce pixel having a smaller ink discharge amount, while the formation step is set at the timing of approximately 15 μs to produce pixel having a larger ink discharge amount in response to the recording signals, for example, it becomes possible to perform the gradational recording effectuated by the larger and smaller dots in accordance with the recording signals, thus providing stabilization for the print quality without changing the discharge speeds and frequencies considerably in both steps. With the timing being made more multiple, it becomes possible to perform a multi-gradational recording in good condition.

Also, when forming smaller dot pixels, only one heater is driven, and when forming larger dot pixels, the timing is set with reference to FIGS. 16A to 16C so as not to make the discharge speed too great as compared with the driving of one heater for the formation of the smaller dot pixels. In this way, the same effect is obtainable as described earlier. In this case, when the two heaters are driven to form the larger dot pixels, the ink discharge amount becomes larger than that of the smaller dot pixels to be formed by driving one heater. Also, to form the smaller dot, only one heater is driven, hence implementing the energy saving.

With the adjustment of driving timing of both heaters as described above, it becomes possible to overcome the difficulty that the conventional art has encountered in the recording to be executed at the timing of approximately 30 μs with the sufficient ink discharge amount (40 pl) at the discharge speed which is not too high (8 m/s), for example. When the two heaters are driven at a time (with the delay time 0 μs), the ink discharge amount of 40 pl is also obtainable. However, the discharge speed becomes 12 m/s at which the problem of splashing tends to occur more often.

With the timing being set at approximately 15 μs, it may be possible to record at comparatively higher speed with a smaller amount of ink discharge. Here, when the larger heater on the rear side is driven earlier than the smaller heater on the front side, it is possible to obtain a larger discharge amount Vd without making the discharge speed v too fast.

Figure 19:
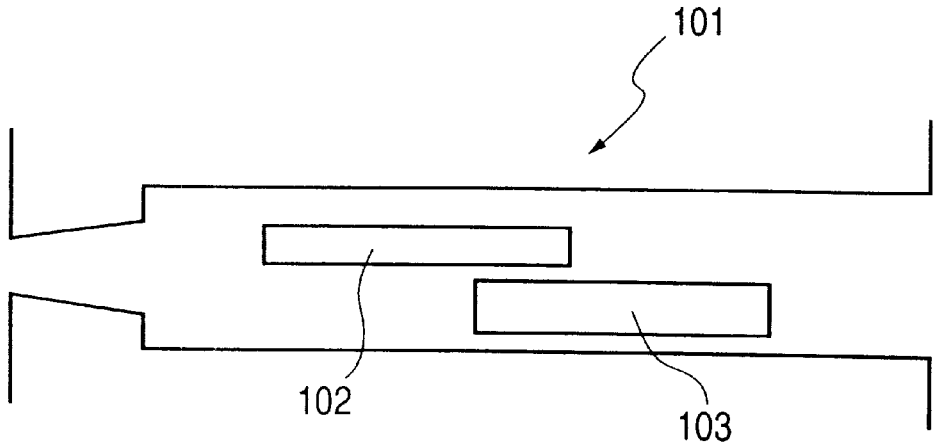
FIG. 19 is a view which schematically shows a nozzle used for a fourth embodiment in accordance with the present invention.

In this respect, FIG. 19 is a view which shows the nozzle 101 in accordance with another embodiment. As shown in FIG. 19, the front side heater 102 and the rear side heater 103, which are configured to be long and narrow, are arranged shiftingly.

Figure 20A:
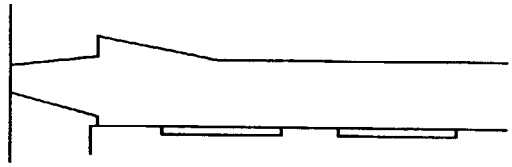
FIGS. 20A, 20B, 20C, 20D, 20E and 20F are views which schematically illustrate the state of the nozzle portion in accordance with the third embodiment of the present invention.
Figure 20B:
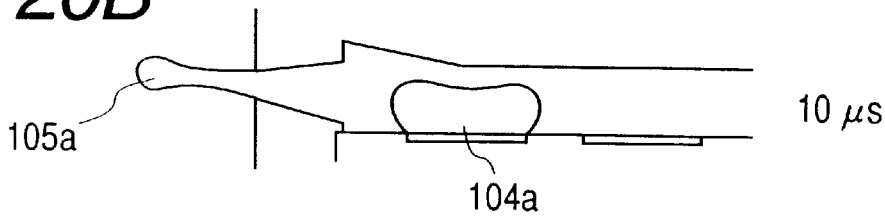
Figure 20C:
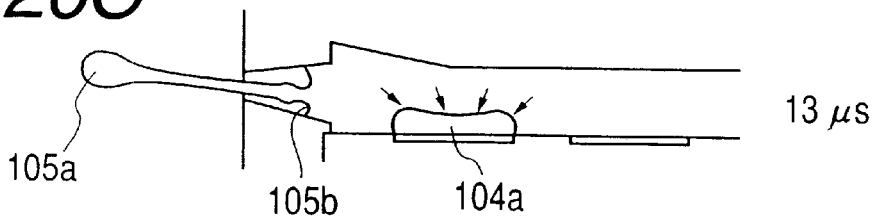
Figure 20D:
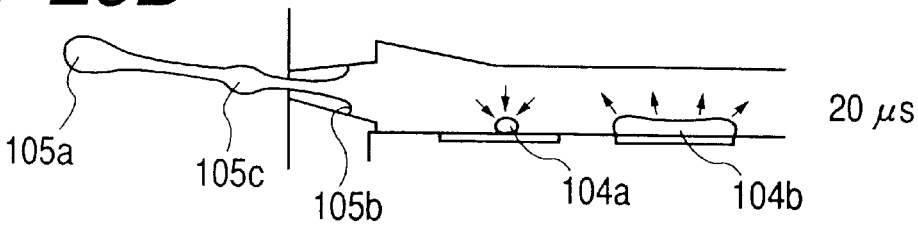
Figure 20E:
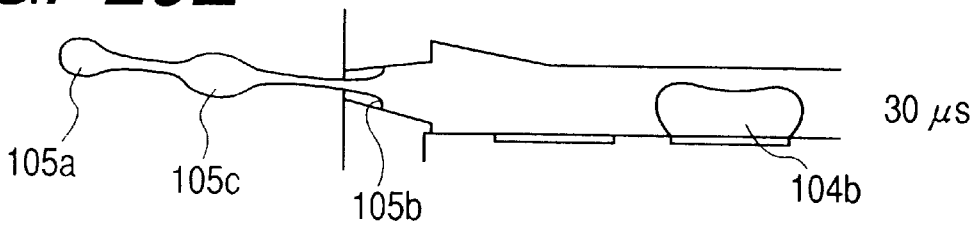
Figure 20F:
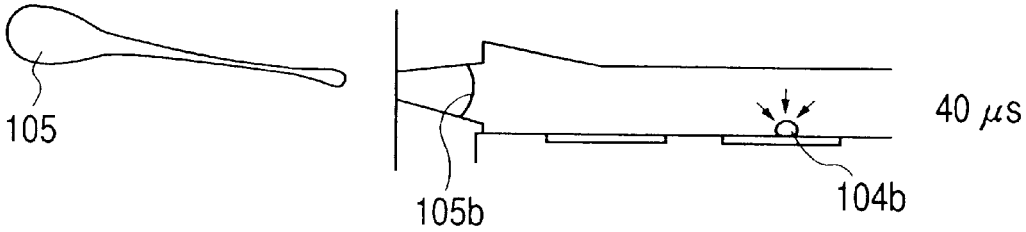

In accordance with the present embodiment, when printing signals are received, the front side heater 102 is at first driven by the driving circuit (not shown). Then, the rear side heater 103 is driven when 20 μs has elapsed. Here, FIGS. 20A to 20F are views which schematically illustrate each state of ink and bubble in the nozzle 101 of the present embodiment as the time elapses. In FIGS. 20A to 20F, there are indicated the elapsed time since the start of driving the front side heater 102 in each of the events, respectively. FIG. 20A shows the state before heaters are driven, and when the front side heater 102 is driven, film boiling takes place in ink to create a bubble 104*a*. By the bubbling pressure exerted by this bubble 104*a*, ink discharge begins at the discharge port (see FIG. 20B).

After that, when the expansion of the bubble made by the front heater 102 is settled, and the contraction of the bubble 104*a* begins (see FIG. 20C), the constriction occurs on the ink liquid column at the discharge port portion. Then the meniscus is formed. The ink droplet 105, which is being discharged from the nozzle, advances forward without any retraction (at this point, the volume of the ink droplet 105 is approximately 10 pl and the discharge speed is approximately 7 m/s). Any other ink than this droplet is drawn in from the discharge port along the contraction of the bubble 104*a* due to the bubbling pressure thereof. Thus, the meniscus 105*b* is retracted from the nozzle opening portion 101*a*. Then, after 20 μs has elapsed since the driving of the front side heater 102, the rear side heater 103 is driven. Thus, a bubble 104*b* is created with heating given by the heater 103 (see FIG. 20D). At this juncture, the contraction of the bubble 104*a* and the expansion of the bubble 104*b* make progress simultaneously. As a result, the ink suction due to the contraction of the bubble created on the front side is offset by the expansion of the bubble 104*b* which has been created on the rear side. Here, moreover, since the rear side heater 103 is larger and the action thereof is greater, the expansion of the bubble 104*b* functions not only to offset the contraction of the bubble 104*a*, but also, enable the meniscus 105*b* to advance again. Thus, the second liquid droplet portion 105*c* is formed on the trailing end of the first liquid droplet portion 105*a* of the ink droplet 105. Here, for the convenience' sake, the larger diameter portion of the ink droplet formed by the driving of the front side heater 102 is indicated as the first liquid droplet portion 105*a*, and the larger diameter portion of the ink droplet formed by the rear side heater 103 as the second liquid droplet portion 105*c*. However, in accordance with the present embodiment, the second liquid droplet portion 105*c* is formed before the tail section of the first liquid droplet portion 105*a* is cut off in the nozzle 101. Therefore, the ink droplet 105 becomes the one having the larger diameter portion like a knot in two locations thereof.

After that, the bubble 104*a* is made extinct, while the bubble 104*b* is continuously expanded. Then, the ink droplet 105 further advances (see FIG. 20E). When the bubble 104*b* is contracted after having expanded, the ink droplet 105 is cut off from ink in the nozzle 101, and the meniscus 105*b* is retracted (see FIG. 20F). Since the second liquid droplet portion 105*c* is created in the state where the meniscus 105*b* has comparatively retracted, and its advancing speed is fast. Therefore, it catches up with the first liquid droplet portion 105*a* in the ink droplet 105. The ultimate discharge amount of the ink droplet 105 is approximately 30 pl, and the discharge speed is approximately 8 m/s.

(Embodiment 4)

Now, with reference to FIGS. 21A to 21F, the description will be made of a fourth embodiment in accordance with the present invention.

Figure 21A:
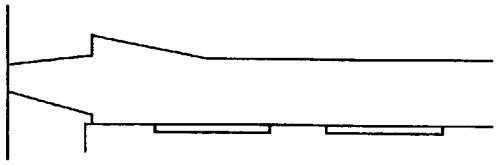
FIGS. 21A, 21B, 21C, 21D, 21E and 21F are views which schematically illustrate the nozzle portion in accordance with the fourth embodiment of the present invention.
Figure 21B:
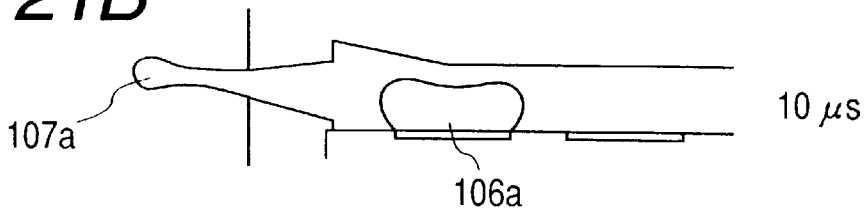
Figure 21C:
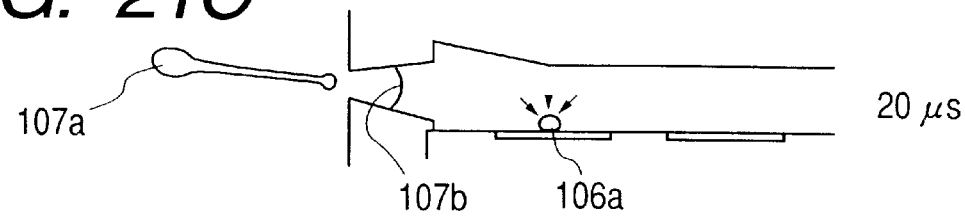

In accordance with the present embodiment, after 25 μs has elapsed since the driving of the front side heater 102, the rear side heater 103 is driven. In FIGS. 21A to 21F, there are indicated the elapsed time since the start of driving the front side heater 102 in each of the events, respectively. FIG. 21A shows the state before heaters are driven, and when the front side heater 102 is driven, film boiling takes place in ink to create a bubble 106*a*. Then, as in the third embodiment, the bubble 106 is gradually expanded to begin the ink discharge (see FIG. 21B). After that, when the expansion of the bubble by the front heater 102 is settled, and the contraction of the bubble 106*a* begins (see FIG. 21C). At this juncture, the ink droplet (a first ink droplet) 107*a* is discharged from the nozzle. Ink remaining in the nozzle is drawn in along the contraction of the bubble 106*a*. The meniscus 107*b* is retracted from the nozzle opening edge 101*a*.

Figure 21D:
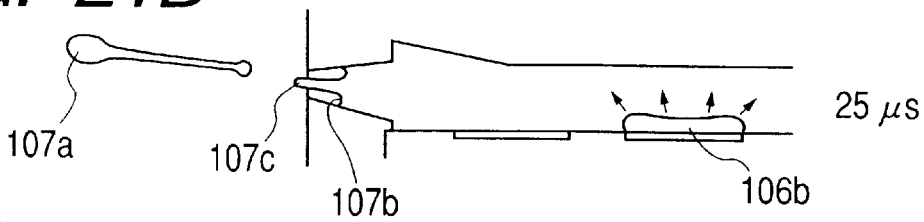
Figure 21E:
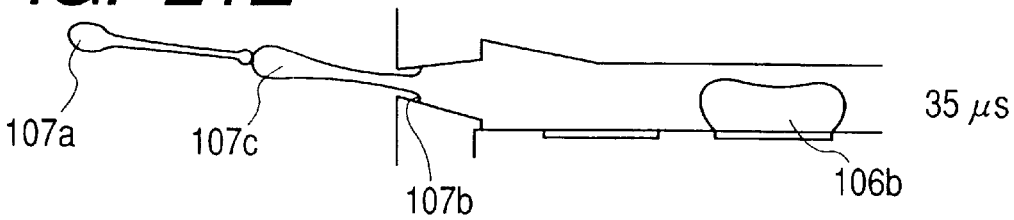
Figure 21F:
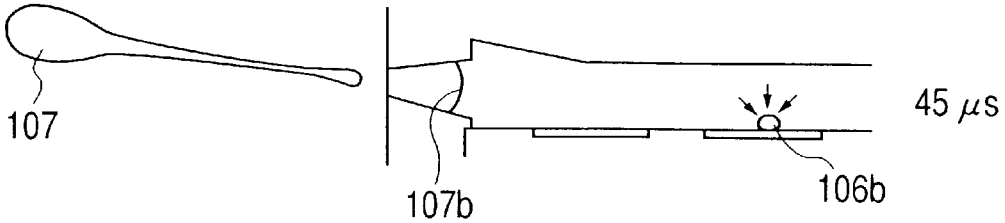

Then, after 25 μs has elapsed since the driving of the front side heater 102, the rear side heater 103 is driven to create a bubble 106*b* with heating given by the rear side heater 103 (see FIG. 21D). At this juncture, the bubble 106*a* is extinct. Here, the rear side heater 103 is larger and the action thereof is greater, and as the expansion of the bubble 106*b* advances, the meniscus 107*b* makes progress forward again. Then, the second ink droplet 107*c* is discharged behind the first ink droplet 107*a*. The speed of the second ink droplet 107*c* is approximately 9 m/s as clear from FIG. 16A, which is faster than the speed of the first ink droplet 107*a*. Therefore, the second ink droplet catches up with the first ink droplet so that both ink droplets 107*a* and 107*c* are combined (are made one body) (see FIG. 21E).

After that, the bubble 106*a* is contracted and made extinct soon. Along with this extinction, the meniscus 108 is retracted. At this juncture, the combined ink droplet 107 flies substantially at the same speed as the first ink droplet 107*a* (see FIG. 21F).

In this respect, the amount of meniscus 107*b*, which is retracted after the completion of the ink discharge as described above, may exert influence on the next ink discharge. However, this retracting amount of meniscus is determined by the balance between the inertance (flow path resistance) on the front side and the inertance on the rear side of the heater in use when the disappearing takes place on the rear side heater. Therefore, if the front side inertance (flow resistance) is greater as in the present embodiment, the retracting amount of the meniscus becomes smaller. Then, the printing frequency is enhanced.

(Embodiment 5)

Now, the description will be made of a discharge method which is particularly effective when discharging smaller liquid droplets.

Hereinafter, with reference to the accompanying drawings, the description will be made of a fifth embodiment in accordance with the present invention.

Figure 22:
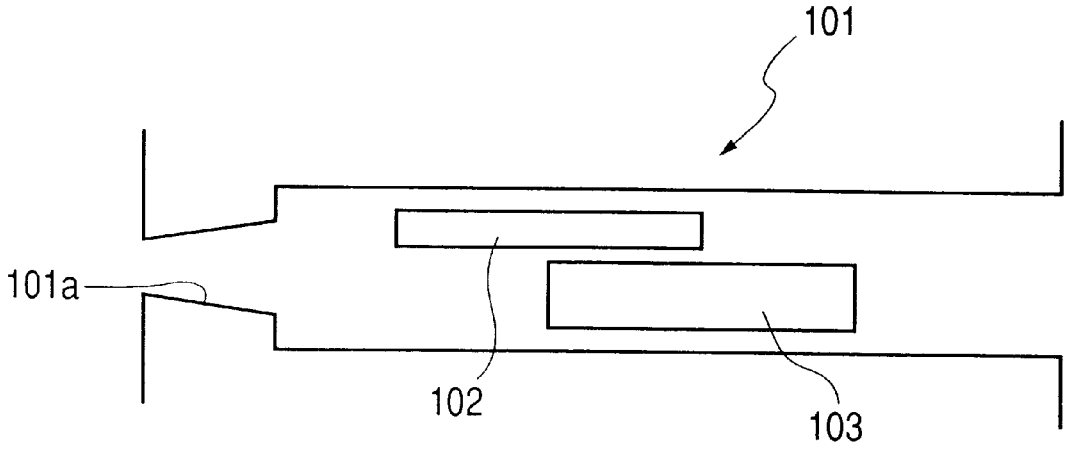
FIG. 22 is a view which schematically shows a nozzle used for a fifth embodiment in accordance with the present invention.

FIG. 22 is a view which shows a nozzle 101 used for ink discharges in accordance with the fifth embodiment hereof. In the nozzle 101, there are arranged a narrower front side heater 102 on the nozzle opening edge side 101*a*, and a wider rear side heater 103 on the location behind it. For the ink jet recording method of the present embodiment, the front side heater 102 is, at first, driven by a driving circuit (head driver), which will be described later, when printing signals are received. Then, after that, the rear side heater 103 is driven. In accordance with the present embodiment, the driving timing for both heaters 102 and 103 is set in a range of 10 to 15 μs or preferably, in a range of 11 to 14 μs approximately. Optimally, a single voltage pulse of 4 μs wide should be applied at intervals of 12 μs approximately. Now, the description will be made of this driving timing.

The applicant hereof has measured the ink discharge speed v, the discharge amount Vd, and the refilling frequency fr with the driving timing of both heaters 102 and 103 being made changeable. Further, the voluminal changes of bubble after bubbling is observed with the results indicated in FIGS. 23A to 23D.

In accordance with such measurement and observation, when the delay timing (interval) of the heater 103 which is driven later than the heater 102 which has been driven earlier is in a range of 10 to 15 μs, particularly in the range of 12 μs, the discharge speed v is comparatively large (approximately 8 m/s), and the refilling frequency is substantially at the maximum value (13.5 to 13.8 kHz approximately), while the ink discharge amount vd is kept substantially at the minimum value (10 pl). Therefore, if the timing is set within this range, it becomes possible to form fine dots, each with a smaller amount of ink at a higher discharge speed, and a higher refilling frequency as well.

In contrast, if the timing is 0 μs (two heaters are driven at a time), the ink discharge amount Vd is larger (approximately 40 pl), and the frequency fr is extremely lower (approximately 10 kHz), although the discharge speed v is faster (approximately 12 m/s). In other words, the retracting amount of the meniscus becomes greater after discharge, which necessitates an extra time for refilling. Therefore, a longer interval of the ink discharges should be provided so as not to perform any higher printing. Also, in a timing range of 0 μs or more to approximately 10 μs, the discharge speed v and the frequency fr are made lower and any significant effect is not anticipated any longer, although the ink discharge amount Vd is gradually made smaller. On the other hand, if the timing exceeds 15 μs, the discharge amount Vd becomes greater abruptly, while the frequency fr is made lower. Therefore, any higher printing cannot be attained, either.

In this respect, when only the front side heater 102 is driven, the discharge amount is 10 pl, the discharge speed is 6 m/s, and the refilling frequency is 10 kHz, approximately. Only the rear side heater 103 is driven, the discharge amount is 30 pl, the discharge speed is 10 m/s, and the refilling frequency is 14 kHz, approximately. From these findings, the discharge speed of approximately 8 m/s with the delayed driving by approximately 12 μs is faster than that of the driving only by the front side heater 102. Here, it is conceivable that the larger size of the rear side heater 103 contributes to the presentation of this faster speed.

With all these aspects in view, it becomes possible to print at higher speeds by minimizing the discharge amount Vd substantially, with the timing being set in a range of 10 to 15 μs. Particularly, in a timing range of 11 to 14 μs, this effect is obtainable most remarkably.

Figure 23A:
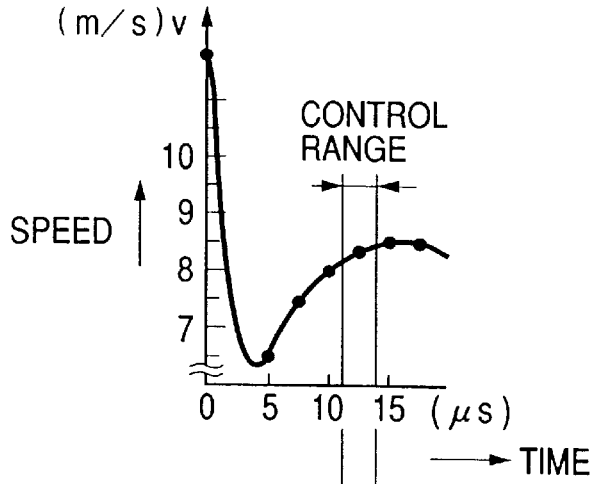
FIG. 23A is a view which shows the relationship between the heater heating timing and the discharge speeds in accordance with the fifth embodiment of the present invention.
Figure 23B:
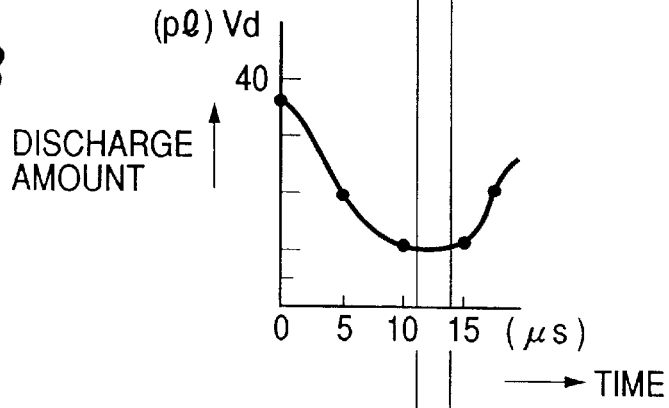
FIG. 23B is a view which shows the relationship between the heater heating timing and the discharge amounts.
Figure 23C:
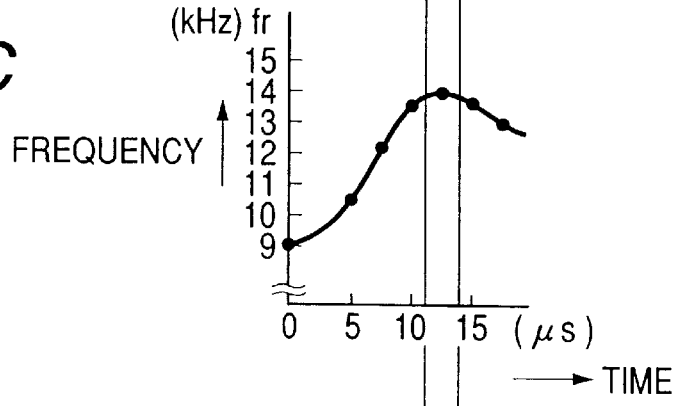
FIG. 23C is a view which shows the relationship between the heater heating timing and the printing frequency.
Figure 23D:
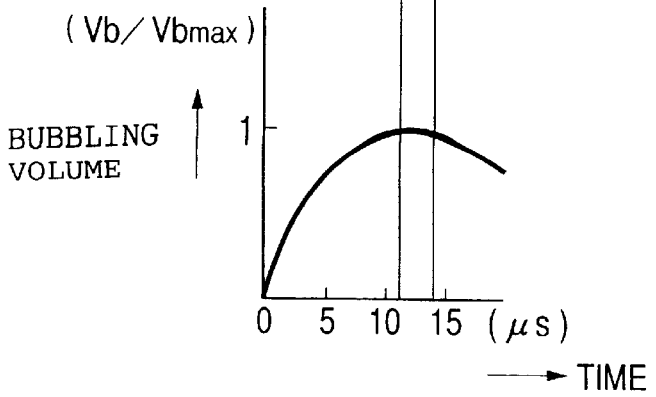
FIG. 23D is a view which shows the relationship between the elapsed time after bubbling and the bubbling volume.

FIG. 23D shows the voluminal ratio between the development and contraction of the bubble after the creation of the bubble and on subsequent to the front side heater 102 having been driven. In accordance with such ratio, the volume of the bubble becomes maximum, that is, (Vb/Vbmax=1), approximately in a range of 10 to 15 μs after the front side heater 102 has been driven. The observation on this aspect will be given below.

At first, the heater (here, the front side heater 102) is driven to create a bubble for discharging ink. Then, along with the contraction (extinction) of the bubble, ink around the bubble is drawn in, and at this juncture, a bubble is created by driving the rear side heater (here, the rear side heater 103). Then, the contraction and disappearing of the previous bubble is offset by the creation and development of the later bubble. In other words, in synchronism with the contraction of the previous bubble, the later bubble is developed. In this manner, the total volume of bubbles is kept constant in a certain period of time. During such period, ink scarcely flows. Consequently, the retraction of the meniscus, which is cased by the ink being drawn into the interior of the nozzle, is made smaller.

The function of the driving method of the present invention may be defined as the adjustment of a refilling frequency to the one that may be obtainable when only the post-driving heater is driven. As described above, it is conceivable that the meniscus controlled by means of the post-driving heater functions to govern the refilling frequency of this method.

Particularly, when the front side heater 102 is driven earlier, and the rear side heater is driven later, the ink droplet is discharged at faster discharge speed when the front side heater 102 is driven, because the inertance (flow path resistance) of the front side heater 102 is smaller in front of it, while the inertance is larger in back of it. As a result, the inverted flow of ink toward the rear side can hardly take place. Also, the inertance in front of the rear side heater 103 is larger, while the inertance in back of it is smaller. Therefore, when the bubble created by the driving of the rear side heater 103 is contracted to disappear, ink on the rear side is drawn more than that on the front side. As a result, it becomes possible to suppress the retraction of meniscus which is caused by the drawing of ink on the front side. Here, then, with ink being drawn from the rear side, the efficiency of refilling (ink refilling) is enhanced. In this way, even compared with the ink discharge performed by use of the front side heater 102 alone, refilling frequency is enhanced to make printing possible at higher speeds. Here, on the contrary, the influence of the creation and development of rear side bubble is absorbed by the contraction and disappearing of the front side bubble. As a result, there is no possibility that the ink droplet is discharge externally from the nozzle opening edge even when the rear side heater 103 is driven.

In accordance with the present invention, the higher printing is attained on the basis of such principle as described above. It is necessary to arrange the contraction and disappearing of the front side bubble to be effectuated in synchronism with the creation and development of the rear side bubble. To this end, it is desirable to set the timing so that the bubble is created with heating by the rear side heater in a state where the bubble which has been created earlier presents the maximum volume, and thereafter, the bubble may take its course of contraction only. In this way, by driving both heaters with the deviated timing, it becomes possible to enhance the refilling frequency in order to obtain images in higher quality at higher speed, while maintaining the ink discharge amount smaller.

Figure 24:
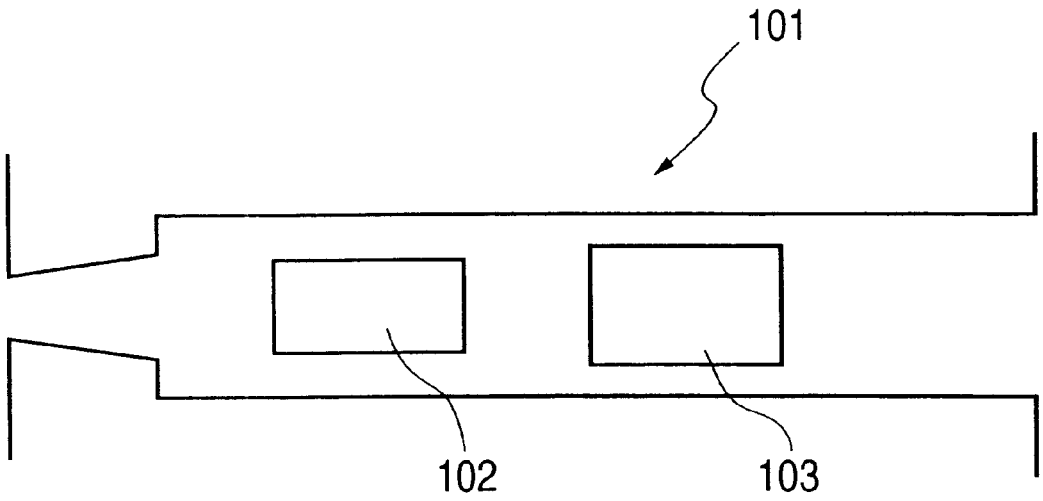
FIG. 24 is a view which schematically shows a nozzle in another mode, which is used for the fifth embodiment in accordance with the present invention.
Figure 25:
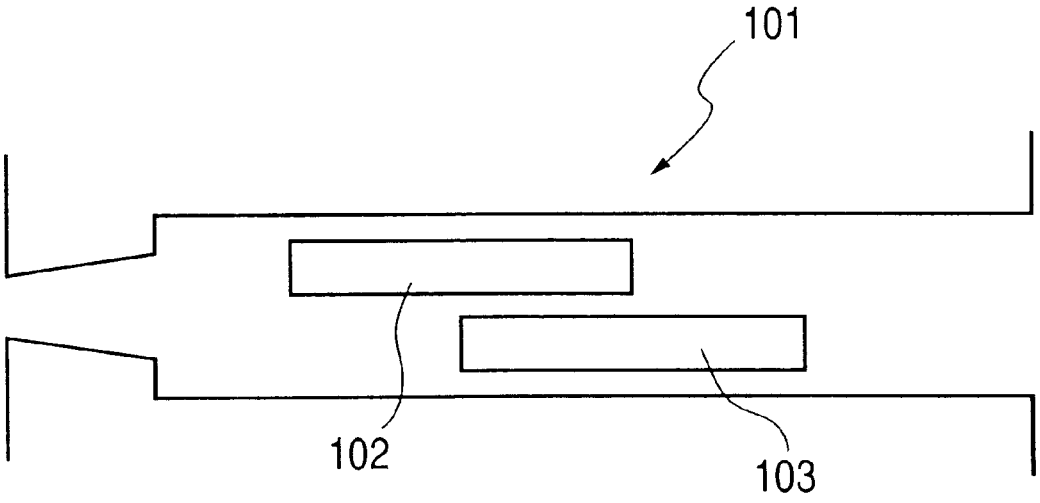
FIG. 25 is a view which schematically shows a nozzle in still another mode, which is used for the fifth embodiment in accordance with the present invention.

In this respect, FIG. 24 shows the nozzle in accordance with another embodiment of the present invention. This nozzle 101 is provided with a smaller front side heater 102 and a larger rear side heater 103, which are arranged in series on the front and back sides, respectively. In this case, the obtainable effect is the same as in the case represented in FIG. 22. Also, FIG. 25 shows the nozzle in accordance with still another embodiment of the present invention. For the nozzle 101, there are provided the front side heater 102 and the rear side heater 103 in the same configuration, but these heaters are partly deviated in its arrangement. In this case, the discharge speed v does not change so greatly as in the case represented in FIG. 22.

Also, the driving pulses may be not only the single pulse as described above, but may be double pulse, or may be the complex pulse formed by them together.

Also, each of the heaters shown in FIG. 22, FIG. 24, and FIG. 25 can be driven individually. It is preferable to unify the bubbling initiation voltage so that any one of them can be driven by the application of one and the same driving voltage. For that matter, the length of each heater is made substantially equal.

As to the sizes of the heaters, the front side heater (nearer to the discharge port) is made smaller than the one on the rear side (father away from the discharge port) or it is preferable to make them substantially the same.

Figure 26:
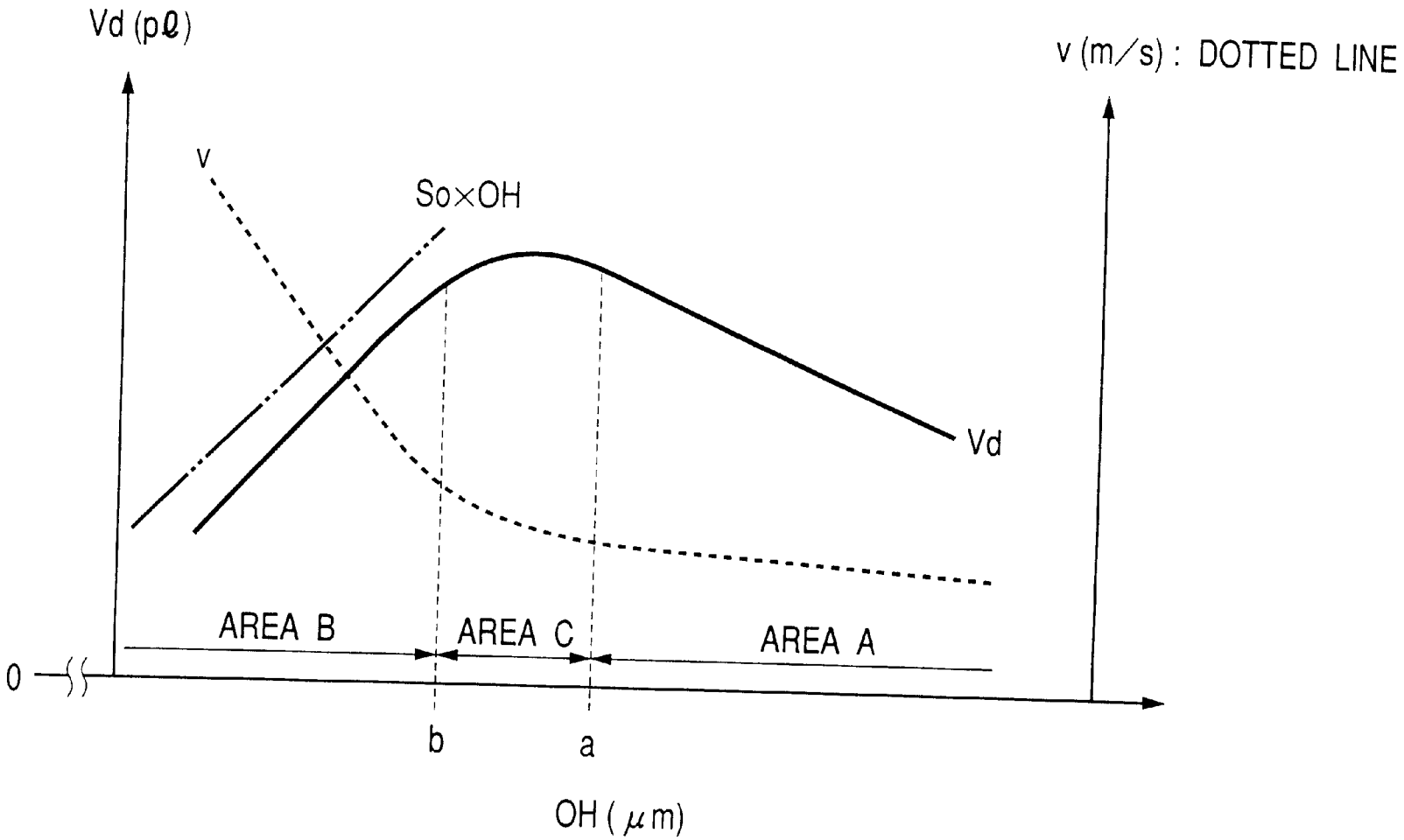
FIG. 26 is a graph which shows the relationship between the ink discharge amount Vd and the discharge speed v with respect to a distance OH from a heater.

FIG. 26 is a graph which shows the relationship between the ink discharge amount Vd and the discharge speed v with respect to the distance OH from the discharge port of the heater when one heater is driven independently, and which also shows the product of the area So of the discharge port and the distance OH together.

In FIG. 26, the singular points a and b are regulated, and the distance OH is divided into three areas: the area equal to or more than a is designated as A; the area equal to or less than b, as B; and the area between a and b, C. The characteristic tendency of each area is: in the area S, the discharge speed v and the discharge amount Vd are substantially proportional as the distance OH is increased, and the v/Vd is almost constant; in the area B, the discharge amount Vd is almost proportional to the product of the discharge area So and the distance OH, and the discharge speed v is inversely proportional. Then, the v/Vd is reduced as the distance OH is increased; and in the area C, the discharge amount Vd is almost constant. From the characteristic tendency described above, if two heaters are arranged in one flow path with attention given to the discharge amount Vd, for example, it is preferable to arrange the front side heater in the area B, and the rear side heater in the area A so that the discharge amount Vd becomes almost the same.

Also, each of the above areas may be defined as given below with attention given to each of the discharge amounts Vd and the discharge speeds v, respectively.

<From the Viewpoint of the Discharge Amount Vd>

Area A: The zone in which the discharge amount Vd is reduced as the distance OH is increased.

Area B: The zone in which the discharge amount increases almost in proportion to the distance OH.

Area C: The zone in which the discharge amount Vd is almost constant with respect to the distance OH.

<From the Viewpoint of the Discharge Speed v>

Over all zones, the discharge speed v is made slower along with the increase of the distance OH. Particularly, in the area C, its changing amount becomes moderate.

As to the heater positions, it is preferable to position the front side heater in the area B. Then, it becomes possible to discharge finer droplets at higher speeds.

In accordance with the present embodiment, when printing signals are received, the front heater 102 is at first driven by the driving circuit (not shown). Then, the rear side heater 103 is driven when 12 $\mu$s has elapsed. Here, FIGS. 27A to 27F are views which schematically illustrate each state of ink and bubble in the nozzle 101 of the present embodiment as the time elapses. In FIGS. 27A to 27F, there are indicated the elapsed time since the start of driving the front side heater 102 in each of the events, respectively. FIG. 28 shows the driving pulse A of the front side heater 102, and the driving pulse B of the rear side heater 103 as well.

Figure 27A:
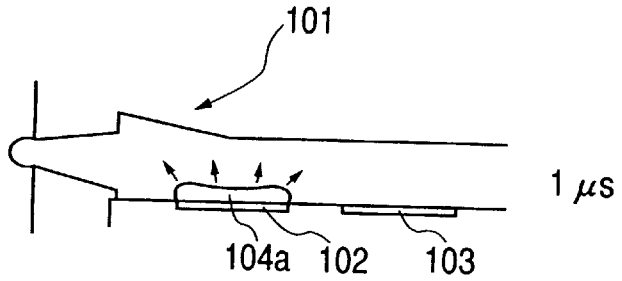
FIGS. 27A, 27B, 27C, 27D, 27E and 27F are views which schematically illustrate the state of the nozzle portion in accordance with the fifth embodiment of the present invention.
Figure 27B:
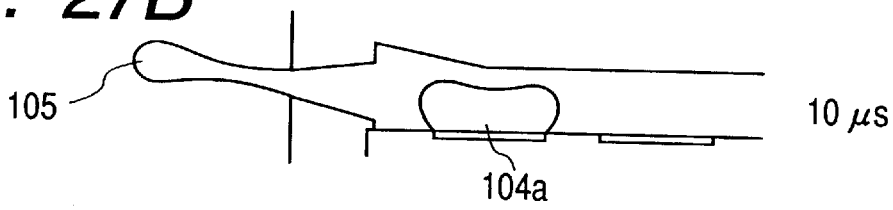
Figure 27C:
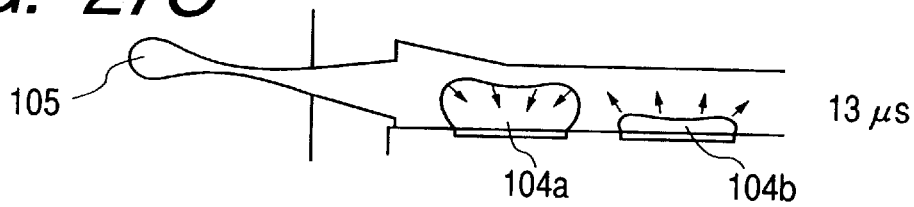
Figures 28A, 28B:
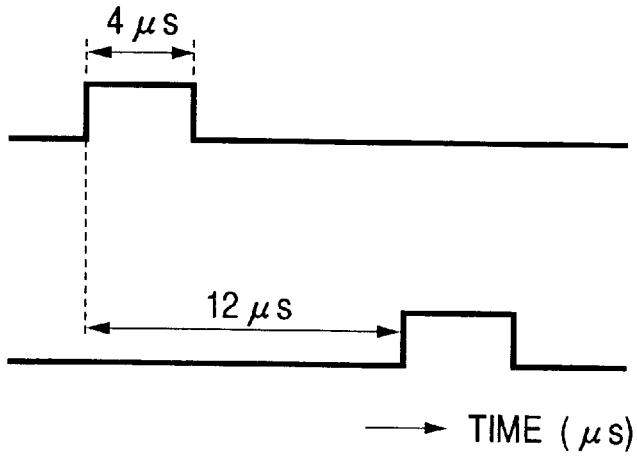
FIGS. 28A and 28B are line diagrams which show the heater driving pulses in accordance with the embodiments of the present invention.

At first, when the front side heater 102 is driven, film boiling takes place in ink to create a bubble 104*a* (see FIG. 27A). By the bubbling pressure exerted by this bubble 104*a*, ink discharge begins at the discharge port (see FIG. 27B), and the bubble is being developed.

Figure 27D:
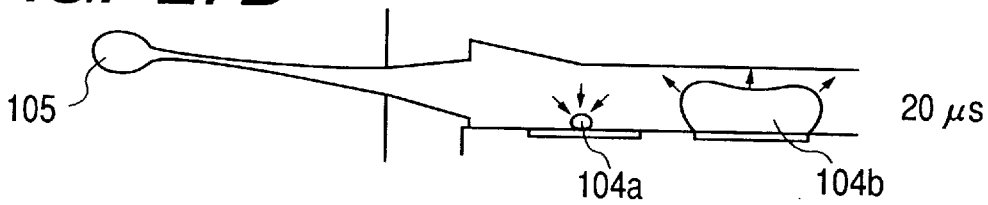

Although not shown in FIGS. 27A to 27F, at the timing of 12 $\mu$s where the maximum volume of the bubble 104 is essentially kept, the rear side heater 103 is driven. After that, when the development of the bubble by means of the front side heater 102 is settled, and the contraction of the bubble 104*a* begins, a bubble 104*b* which has been developed with heating by the rear side heater 103 is increase at the same time (see FIG. 27C). At this juncture, the ink droplet 105, which is being discharged from the nozzle 101, advances forward without any retraction. The bubble 104*a* has already begun to be contracted, and the force that draws in the surrounding ink is activated. However, the pressure exerted by the bubble 104*b* acts upon the surrounding ink to push it out externally. As a result, both of them is offset with each other. In other words, although ink moves only in the extremely limited space in the gap between bubbles 104*a* and 104*b*, there is no particular influence to be exerted upon ink residing in front of the front side heater 102 and in back of the rear side heater 103. As a result, there is no significant fluctuation to occur. At this juncture, there is almost no retraction of the meniscus, either. As shown in FIG. 27D, the situation is the same even when the bubble 104*a* is almost extinct, and the volume of the bubble 104*b* becomes almost maximum.

Figure 27E:
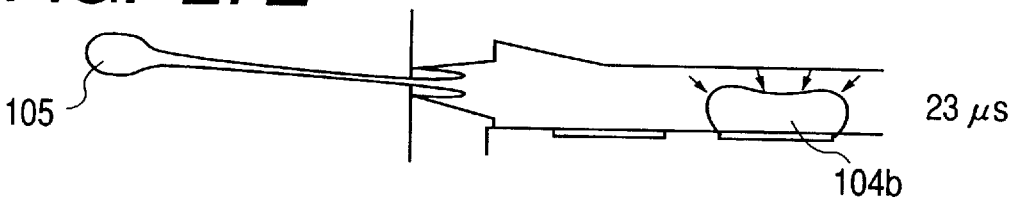
Figure 27F:
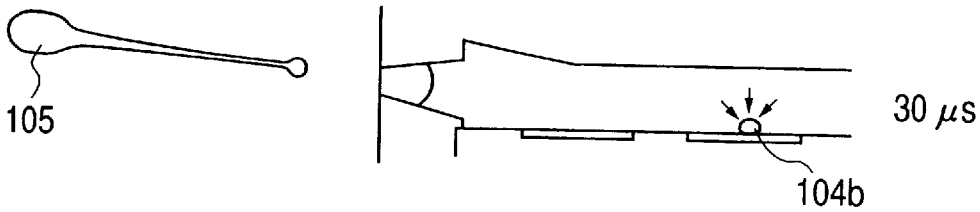

Then, as shown in FIGS. 27E and 27F, after the bubble 104*a* has disappeared, the bubble 104*b* is contracted to disappear, thus acting upon the surrounding ink to be drawn in. However, as described earlier, since the inertance in front of the rear side heater 103 is larger than the inertance in back of the rear side heater 103, the ink suction force exerted by the contraction and disappearing of the bubble 104*b* acts upon the rear portion of the nozzle rather than the front portion thereof. In other words, the ink suction force exerted by the contraction and disappearing of the bubble 104*b* has the promotional effect on the refilling (ink refilling) rather than on the retraction of the meniscus. In this manner, in accordance with the present embodiment, the refilling frequency is enhanced to make higher printing possible. Also, the front and rear inertances of the rear side heater 103 maintain the relationship as described earlier. Therefore, the bubbling created by the rear side heater 103 does not contribute excessively to the ink discharge from the nozzle opening end directly.

(Embodiment 6)

Figure 9:
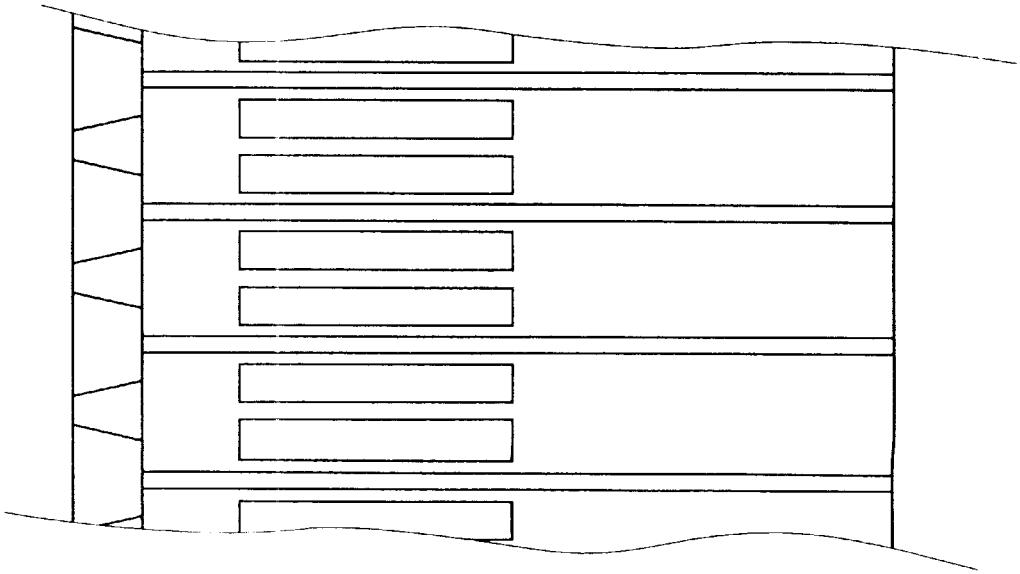
FIG. 9 is a plan view which shows the structure of the interior of the liquid flow path of a liquid jet recording head in accordance with a third embodiment of the present invention.
Figure 10:
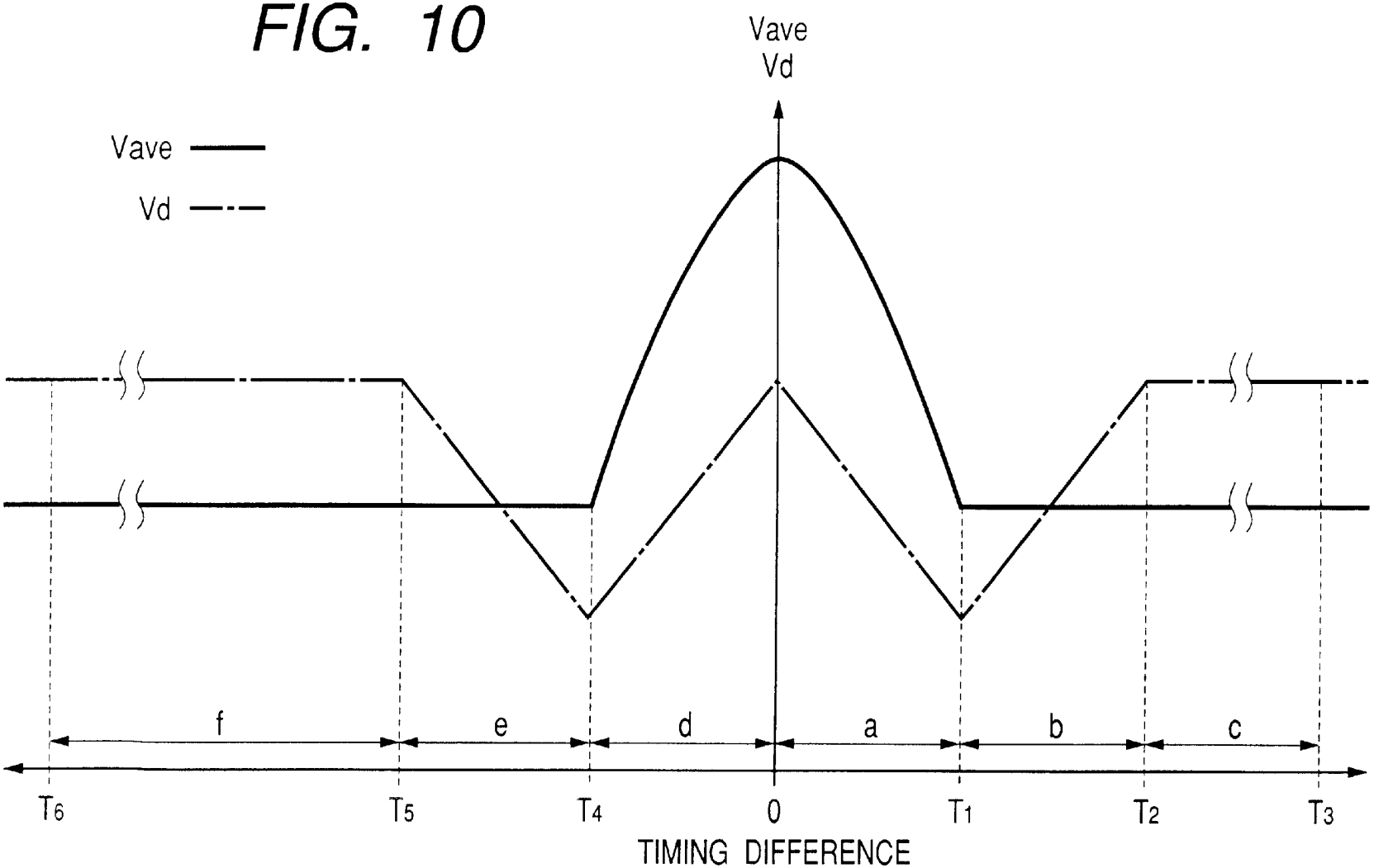
FIG. 10 is a graph which schematically shows the discharge speed Vave and the discharge amount Vd of the discharge liquid discharged by the liquid jet recording head and the discharge method in accordance with a sixth embodiment of the present invention.

FIG. 9 is a view which shows a sixth embodiment in accordance with the present invention. The liquid discharge head is provided with a plurality of heaters in the nozzles, respectively, which are arranged in parallel with the flow path direction at the same position (the distance OH from the edge of the heater on the discharge port side to the discharge port is equal to each of them), each having the same configuration, resistance, and area, respectively. FIG. 10 is a graph which shows the relationship between the discharge speed Vave and the discharge volume Vd, which are obtained by deviating timing of these heaters altogether. The graph is the same as a whole as the one described in conjunction with FIG. 8. As readily understandable from FIG. 9 and FIG. 10, when the timing is deviated for the same heaters in the same positions, the left and right ones (±timing) become symmetrical. Therefore, either one of them may be able to serve as reference. It is of course within the scope of the present invention if these heaters are made different and arranged in parallel with each other or the arrangement thereof is deviated, respectively, (including the case that the heaters are adjacent to each other in the position where the flow paths direction is locally present).

(The Liquid Discharge Head Cartridge)

Now, the description will be made briefly of a liquid discharge head cartridge provided with the liquid discharge head of the above embodiment which is mounted on it.

Figure 11:
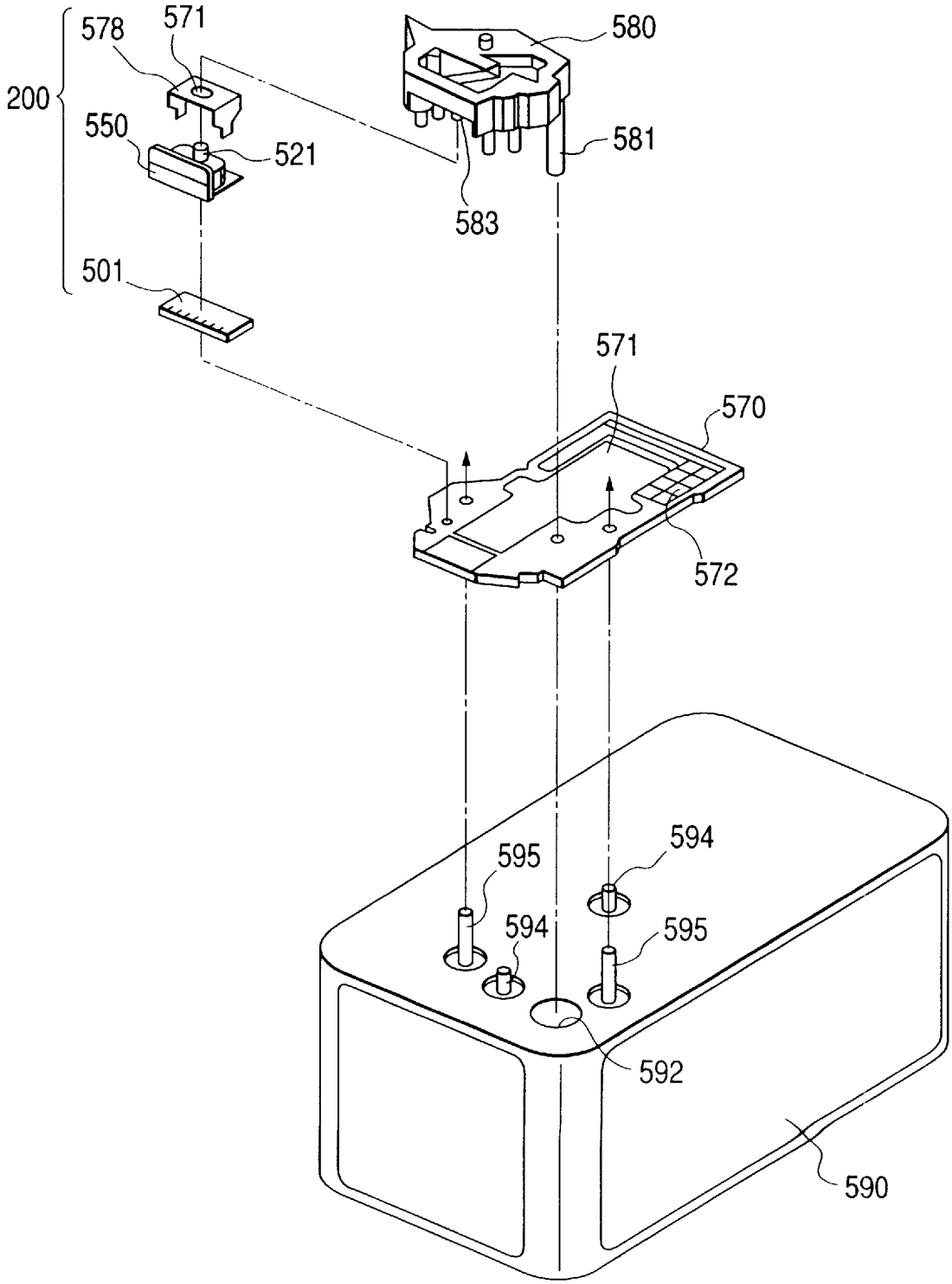
FIG. 11 is an exploded perspective view which shows a liquid discharge head cartridge.

FIG. 11 is an exploded perspective view which schematically shows the liquid discharge head cartridge. Briefly, this liquid discharge head cartridge is mainly formed by a liquid discharge head unit 200 and a liquid container 580.

The liquid discharge head unit 200 comprises an elemental substrate 501, separation walls 530, a grooved member 550, a pressure spring 578, a liquid supply member 590, and a supporting member 570, among some others. On the elemental substrate 501, a plurality of heat generating resistors are arranged in lines, and also, a plurality of functional devices are arranged in order to drive these heat generating resistors selectively. This elemental substrate 501 and the grooved ceiling 550 are bonded to form discharge flow paths (not shown) for distributing discharge liquid to be discharged.

The pressure spring member 578 provides the grooved member 550 with biasing force acting in the direction toward the elemental substrate 501. With this biasing force, the elemental substrate 501, the grooved member 550, as well as the supporting member 570 which will be described later, are integrally formed together in good condition.

The supporting member 570 supports the elemental substrate 501 and others. On this supporting member 570, there are further provided a circuit board 571 connected with the elemental substrate 501 to supply electric signals, and a contact pad 572 which is connected with the apparatus side to exchange electric signals with the apparatus side.

The liquid container 590 retains in it discharge liquid such as ink. On the outer side of the liquid container 590, the positioning unit 594 is provided for the arrangement of a connecting member that connects the liquid discharge head and the liquid container, and the fixing shafts 595 is provided for fixing such connecting member. The discharge liquid is supplied to the liquid supply path 581 of the liquid supply member 580 from the liquid supply path 592 of the liquid container through the supply path 584 of the connecting member, and then, supplied to the common liquid chamber by way of the discharge liquid supply paths 583, 571, and 521 arranged for each of the members.

Here, for this liquid container, the arrangement may be made to use it by refilling liquids after each of them has been consumed. For that matter, it is desirable to provide an injection inlet of liquid for the liquid container. Also, it may be possible to form the liquid discharge head and the liquid container together as one body or form them separable.

(The Liquid Discharge Apparatus)

Figure 12:
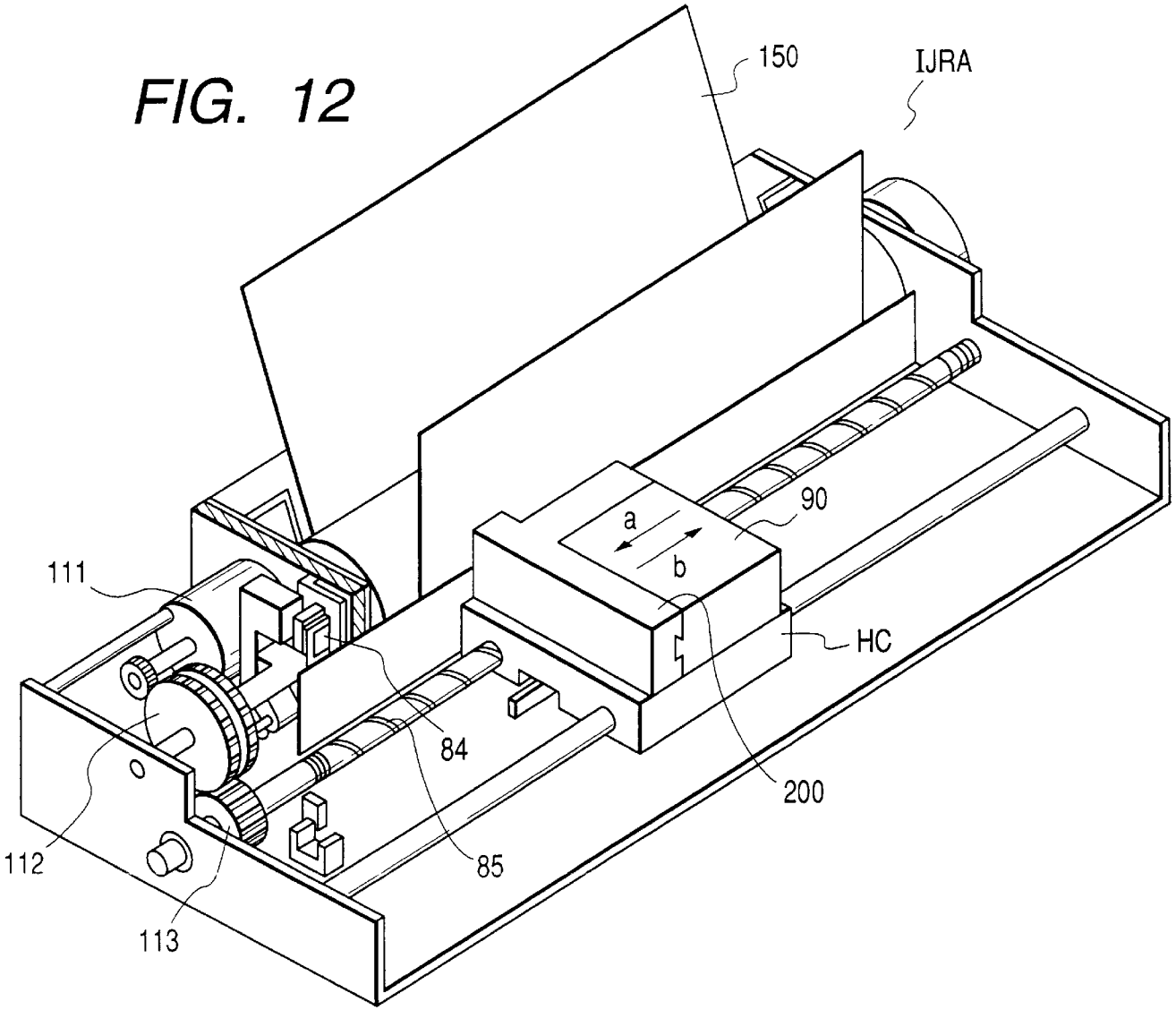
FIG. 12 is a view which schematically shows the structure of a liquid discharge apparatus.

FIG. 12 is a view which schematically shows the structure of a liquid discharge apparatus having mounted on it a liquid discharge head described earlier. Here, in particular, the description will be made of an ink jet recording apparatus that uses ink as discharge liquids. A carriage HC of the liquid discharge apparatus mounts on it a detachable head cartridge structured by a liquid tank unit 90 that retains ink and a liquid discharge head unit 200. The carriage reciprocates in the width direction of a recording medium 150, such as a recording paper sheet, which is carried by means for carrying a recording medium.

When driving signals are supplied to the liquid discharge head unit on the carriage from driving signal supply means (not shown), recording liquid is discharged from the liquid discharge head to the recording medium in accordance with the driving signals.

Also, the liquid jet recording apparatus of the present embodiment is provided with a motor 111 that servers as a driving source, gears 112 and 113, a carriage shaft 115, and others that are needed for transmitting the power from the driving source to the carriage. By use of this recording apparatus and the liquid discharge method adopted therefor, it is possible to obtain images recorded in good condition with the discharge of liquid to various recording media.

Figure 13:
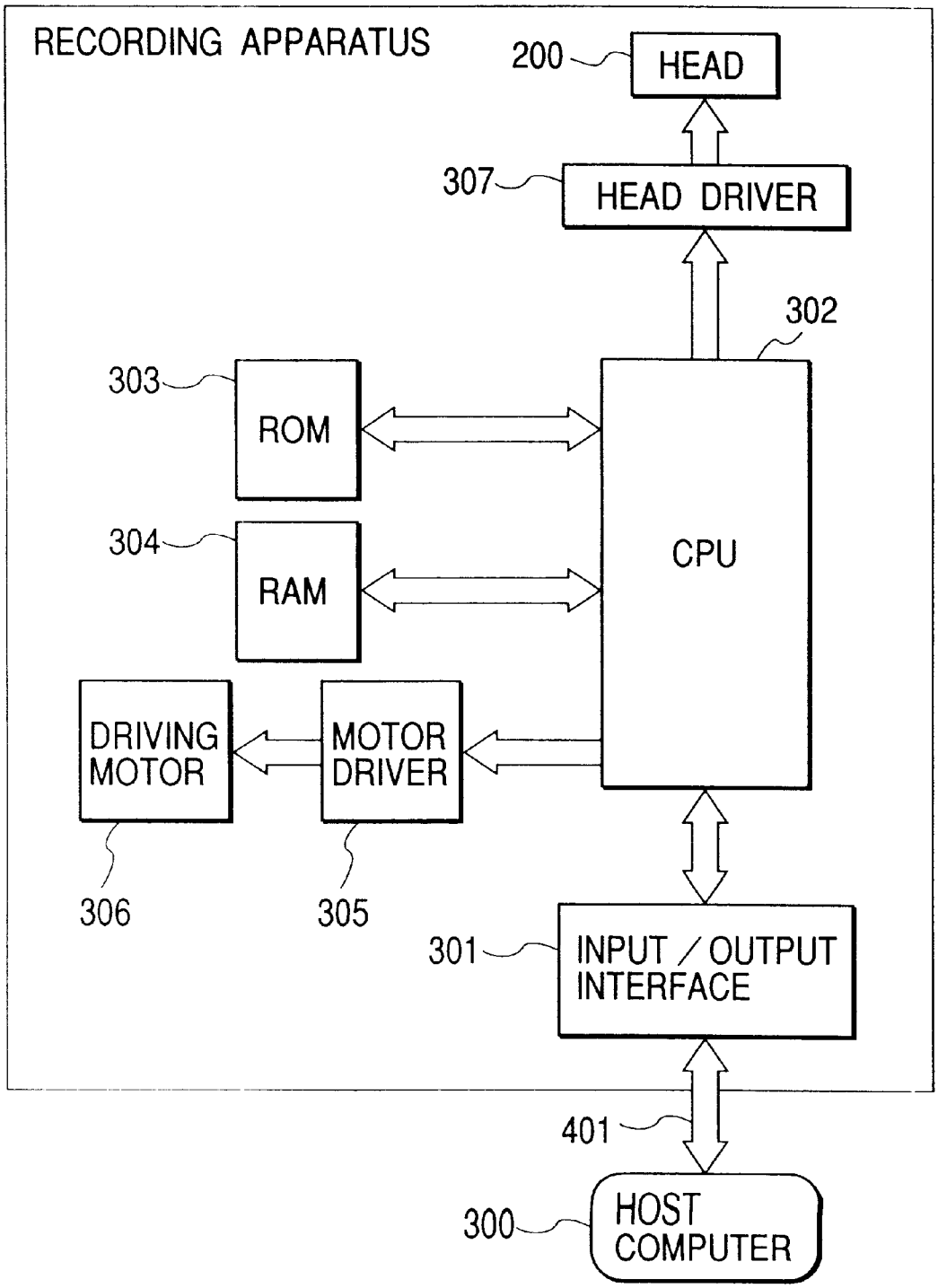
FIG. 13 is a block diagram which shows the liquid discharge apparatus.

FIG. 13 is a block diagram which shows the entire body of the recording apparatus that performs ink jet recording with the application of the liquid discharge method and the liquid discharge head of the present invention.

This recording apparatus receives printing information from a host computer 300 as control signals. The printing information is provisionally held on the input interface 301 arranged in the interior of the recording apparatus. At the same time, the printing information is converted to the data executable by the recording apparatus, and inputted into the CPU 302 which dually serves as means for supplying head driving signals. On the basis of the control program stored on the ROM 303, the CPU 302 processes the data inputted to the CPU 302 using the RAM 304 and other peripheral units, thus converting them into the data to be printed (image data).

Also, the CPU 302 produces the motor driving data to drive the driving motor to move the recording sheet and the recording head in synchronism with the image data thus produced. The image data and motor driving data are transmitted to the head 200 and the driving motor 306 through the head driver 307 and the motor driver 305, respectively. Then, with the controlled timing, the head and motor are driven so that images are formed.

As the recording media which are usable by a recording apparatus of the kind for the provision of ink or other liquids thereon, there may be named various kinds of paper and OHP sheets, plastic material usable for compact disc, ornamental board, or the like, textiles, metallic materials such as aluminum, copper, leather material such as cowhide, hog hide, or artificial leather, wood material such as wood or plywood, bamboo material, ceramic material such as tiles, or three-dimensional structure such as sponge.

Also, as the recording apparatuses described above, there are included a printing apparatus that records on various paper and OHP sheets, a recording apparatus for use of recording on compact discs and other plastic materials, a recording apparatus for use of recording on metal, such as a metallic plate, a recording apparatus for use of recording on leathers, a recording apparatus for use of recording on woods, a recording apparatus for use of recording on ceramics, a recording apparatus for use of recording on a three-dimensional netting structure, such as sponge.

Also, as the discharge liquid to be used for these liquid discharge apparatuses, it should be good enough to adopt the one that matches each of the recording media and recording conditions as well.

(Recording System)

Now, the description will be made of one example of the ink jet recording system whereby to record on a recording medium using the above-mentioned liquid discharge head as its recording head.

Figure 14:
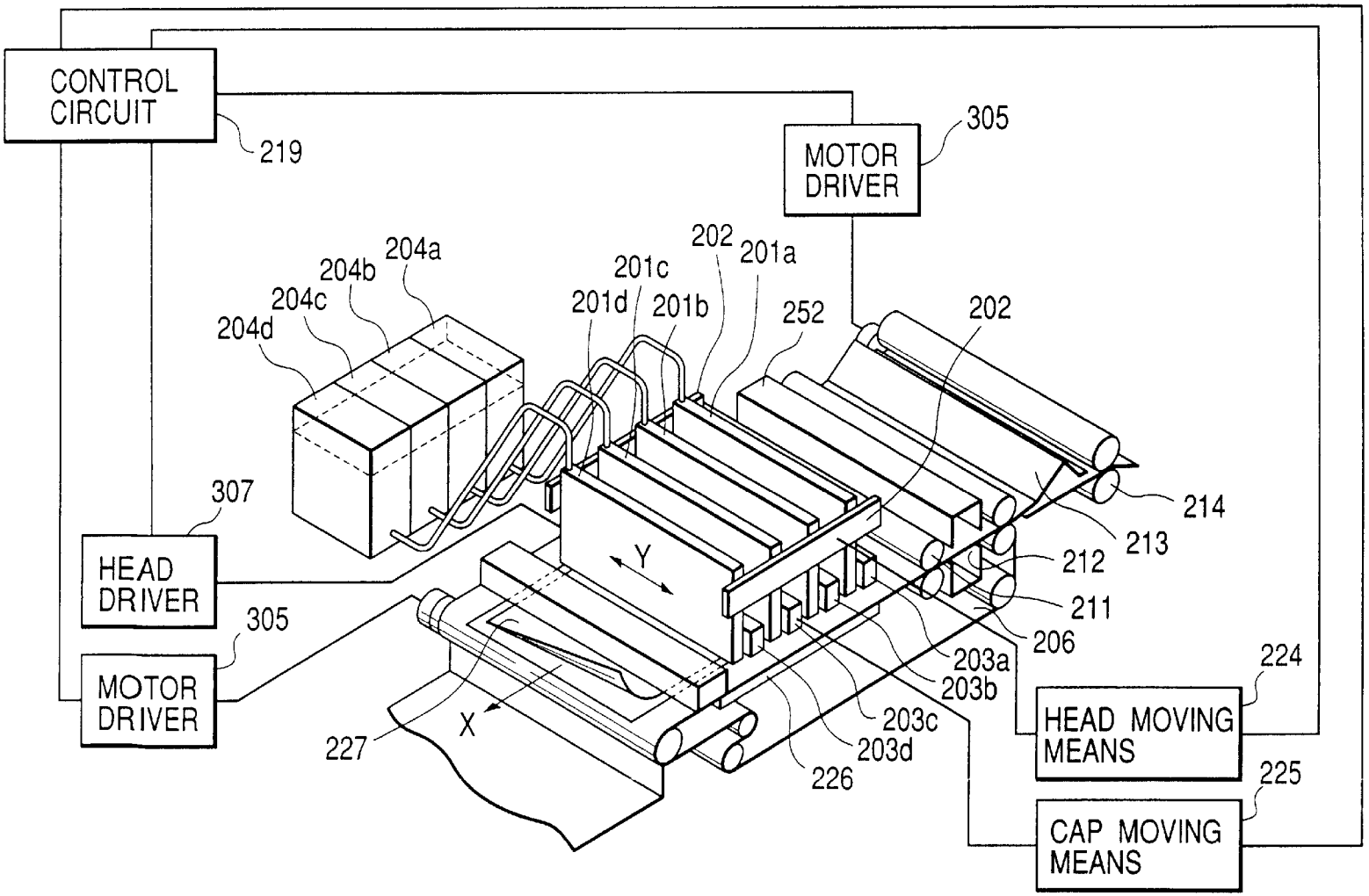
FIG. 14 is a view which shows a liquid jet recording system.

FIG. 14 is a view which schematically illustrates the structure of the ink jet recording system using the liquid discharge head 201 of the present invention.

In accordance with the present embodiment, the liquid discharge head is a full line type head where a plurality of discharge ports are arranged at intervals of 360 dpi in a length corresponding to the recordable width of the recording medium 150. Four liquid discharge heads, each one of them for use of yellow (Y), magenta (M), cyan (C), and black (Bk) color, are fixed and supported by a holder 202 in parallel with each other at given intervals in the direction X.

To these liquid discharge heads, signals are supplied from the head driver 307. On the basis of such signals, each of the liquid discharge heads is driven.

For each of the liquid discharge heads, four color ink of Y, M, C and Bk are supplied from each of the ink containers 204*a* to 204*d*.

Also, on the lower part of each of the liquid discharge heads, there is arranged each of the head caps 203*a* to 203*d* having in it a sponge or some other ink absorbent, respectively. When recording is at rest, each of the liquid discharge heads is covered with each of the head caps in order to keep them in good condition.

Here, a reference numeral 206 designates a carrier belt which constitutes carrier means for carrying various kinds of recording media as described earlier for each of the embodiments. The carrier belt 206 is drawn around a given path by means of various rollers, and driven by driving rollers connected with a motor driver 305.

In this respect, the description has been made using a full line head as the head. However, the head is not necessarily limited to the full line type. It may be possible to adopt a smaller liquid discharge head which is arranged to be in a mode that recording is performed by carrying such head in the width direction of a recording medium.

Of the ink jet recording methods, the present invention is particularly effective in applying it to the ink jet head and recording apparatus which utilize thermal energy.

Regarding the typical structure and operational principle of such method, it is preferable for the present invention to adopt those which can be implemented using the fundamental principle disclosed in the specifications of U.S. Pat. Nos. 4,723,129 and 4,740,796, for example. This method is applicable to the so-called on-demand type recording system and a continuous type recording system as well. However, particularly in the case of the on-demand type, discharge signals are supplied from a driving circuit to electrothermal converting members disposed on a liquid (ink) retaining sheet or liquid path, and in accordance with recording information, at least one driving signal is given in order to provide recording liquid (ink) with a rapid temperature rise so that film boiling, which is beyond nuclear boiling, is created in the liquid, thus generating thermal energy that creates film boiling on the thermoactive surface of the recording head. As a result, a bubble is formed in liquid (ink) by this driving signal one to one. This method is, therefore, particularly effective for the on-demand type recording method. By the development and contraction of the bubble, the liquid (ink) is discharged from each of the discharge ports to produce at least one droplet. The driving signal is more preferably in the form of pulses because the development and contraction of the bubble can be effectuated instantaneously and appropriately. The liquid (ink) is discharged with quicker response. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging openings, liquid paths, and the electrothermal converting members (linear type liquid paths or right-angled liquid paths), as well as may be such structure as disclosed in the specifications of U.S. Pat. Nos. 4,558,333 and 4,459,600 in which the thermal activation portions are arranged in a curved area. All of these structures are within the scope of the present invention. In addition, the present invention is effectively applicable to the structure disclosed in Japanese Patent Laid-Open Application No. 59-123670 wherein a common slit is used as the discharging openings for plural electrothermal converting members, and also, to the structure disclosed in Japanese Patent Laid-Open Application No. 59-138461 wherein an aperture for absorbing pressure wave of the thermal energy is formed corresponding to the discharge ports.

Furthermore, as the mode of the recording apparatus of the present invention, it may be possible to adopt a copying apparatus combined with a reader, in addition to the image output terminal for a computer or other information processing apparatus. Also, it may be possible to adopt a mode of a facsimile equipment provided with transmitting and receiving functions, among some others.

As described above, in accordance with the present invention, a plurality of electrothermal converting members thus provided is driven one after another to make the discharge amount changeable with substantially constant discharge speeds of droplets for the respective difference of driving timing in a driving condition within a range which enables the amount of droplets to change. Then, it becomes possible to change discharge amount, while maintaining the flying speeds of ink droplets substantially constant when arriving at the surface of a recording medium. In this way, high quality prints can be obtained without deviation of impact positions irrespective of the dot diameters, larger or smaller. Further, even when each of the ink droplets formed by a smaller amount of discharge ink is discharged from the nozzle and orifice capable of providing a larger discharge amount, such problems as twisting and disabled discharges may scarcely be encountered, because the discharge speed is not made slower.

What is claimed is:

1. A liquid discharge method for discharging liquid by use of a liquid discharge head provided with a liquid discharge nozzle having a plurality of electrothermal converting members capable of forming a bubble for discharging a liquid droplet, comprising the step of:

driving the plurality of electrothermal converting members sequentially using a driving condition that is in a range making a discharge speed of the liquid droplet substantially constant or same and making a discharge amount of the liquid droplet changeable in accordance with a timing difference of driving timing.

2. A liquid discharge method for a liquid discharge head, according to claim 1, wherein said timing difference is in a range making the discharge speed of the droplet substantially constant or same and enabling the discharge amount to take a minimum value to a maximum value thereof when liquid is discharged in a different discharge amount using said electrothermal converting members altogether.

3. A liquid discharge method for a liquid discharge head according to claim 2, wherein said plurality of electrothermal converting members is arranged in parallel in a direction of liquid flow in a liquid flow path.

4. A liquid discharge method for a liquid discharge head according to claim 1, wherein a first driving pulse for driving any one of said plurality of electrothermal converting members, and a second driving pulse for driving an electrothermal converting member other than the electrothermal converting member driven by said first driving pulse are in different configurations.

5. A liquid discharge method for a liquid discharge head according to claim 1, wherein said plurality of said electrothermal converting members is arranged in series in a direction of liquid flow in a liquid flow path.

6. A liquid discharge method for a liquid discharge apparatus for recording by discharging liquid to a recording medium by a liquid discharge head provided with a liquid discharge nozzle having a plurality of electrothermal converting members capable of forming a bubble for discharging a liquid droplet, comprising the step of:

driving the plurality of electrothermal converting members sequentially using a driving condition in a range making a discharge speed of the droplet substantially constant or same and making a discharge amount of the droplet changeable in accordance with a timing difference of driving timing, said timing difference being in a range enabling the discharged droplet to be formed as one dot on a surface of said recording medium.

7. A liquid discharge method for a liquid discharge apparatus according to claim 5, wherein said timing difference is in a range making the discharge speed of the droplet substantially constant or same and enabling the discharge amount to take a minimum value to a maximum value thereof when liquid is discharged in a different discharge amount using said plurality of electrothermal converting members altogether.

8. A liquid discharge method for a liquid discharge apparatus according to claim 5, wherein a first driving pulse for driving any one of said plurality of electrothermal converting members, and a second driving pulse for driving an electrothermal converting member other than the electrothermal converting member driven by said first driving pulse are in different configurations.

9. A liquid discharge method for a liquid discharge apparatus for recording by discharging liquid to a recording medium by a liquid discharge head provided with a liquid discharge nozzle having a plurality of electrothermal converting members capable of forming a bubble for discharging a liquid droplet, comprising the step of:

driving the plurality of electrothermal converting members sequentially using a driving condition in a range making a discharge speed of the droplet substantially constant or same and making a discharge amount of the droplet changeable in accordance with a timing difference of driving timing, said timing difference being in a range enabling the discharged droplet to be formed as one dot on a surface of said recording medium, wherein said timing difference is in a range enabling a second liquid droplet discharged by a second driving pulse for driving an electrothermal converting member other than an electrothermal converting member driven by a first driving pulse to catch up and collide with a first liquid droplet discharged by the first driving pulse before arriving at the surface of a recording medium, and to impact on the surface of said recording medium as one droplet.

10. A liquid discharge method for discharging liquid by use of a liquid discharge head provided with a liquid discharge nozzle having a plurality of electrothermal converting members capable of forming a bubble for discharging a liquid droplet, comprising the step of:

driving the plurality of electrothermal converting members sequentially using a driving condition that is in a range making a discharge speed of the liquid droplet substantially constant or same and making a discharge amount of the liquid droplet changeable in accordance with a timing difference of driving timing, wherein when a meniscus formed on a discharge port by a first liquid droplet discharged by a first driving pulse for driving any one of said plurality of electrothermal converting members lies between the discharge port and the electrothermal converting member, a second driving pulse for driving an electrothermal converting member other than the electrothermal converting member driven by said first driving pulse is applied.

11. A liquid discharge method for a liquid discharge apparatus for recording by discharging liquid to a recording medium by a liquid discharge head provided with a liquid discharge nozzle having a plurality of electrothermal converting members capable of forming a bubble for discharging a liquid droplet, comprising the step of:

driving the plurality of electrothermal converting members sequentially using a driving condition in a range making a discharge speed of the droplet substantially constant and making a discharge amount of the droplet changeable in accordance with a timing difference of driving timing, said timing difference being in a range enabling the discharged droplet to be formed as one dot on a surface of said recording medium, wherein when a meniscus formed on a discharge port by a first liquid droplet discharged by a first driving pulse for driving any one of said plurality of electrothermal converting members lies between the discharge port and the electrothermal converting member, a driving pulse for driving an electrothermal converting member other than the electrothermal converting member driven by said first driving pulse is applied.

12. A liquid discharge method for discharging liquid by use of a liquid discharge head provided with a liquid discharge nozzle having a plurality of electrothermal converting members capable of forming bubbles for discharging a liquid droplet, comprising the step of:

differentiating a driving timing for driving any one of said plurality of electrothermal converting members to create a resultant liquid velocity that does not have a component in a discharge direction of the nozzle, the resultant liquid velocity being generated by the bubble created by said electrothermal converting member at a time on a discharge port.

13. A liquid discharge method for a liquid discharge head according to claim 12, wherein said driving timing for driving any one of said plurality of electrothermal converting members is differentiated so as to create a liquid velocity component in the discharge direction of the nozzle and a liquid velocity component in a direction opposite to the discharge direction of the nozzle simultaneously on the discharge port on any one of said plural electrothermal converting members.

14. A liquid discharge method for discharging liquid in a different discharge amount by use of a liquid discharge head provided with a liquid discharge nozzle for discharging liquid by a bubble created by a plurality of electrothermal converting members, comprising the step of:

driving the plurality of electrothermal converting members sequentially using a driving condition in a range making a discharge speed of a droplet substantially constant and making a discharge amount of the droplet changeable in accordance with a timing difference of driving timing.

15. A liquid discharge method for a liquid discharge apparatus for recording by discharging liquid to a recording medium in a different discharge amount by use of a liquid discharge head provided with a liquid discharge nozzle for discharging liquid by a bubble created by a plurality of electrothermal converting members, comprising the step of:

driving the plurality of electrothermal converting members sequentially using a driving condition in a range making a discharge speed of a droplet substantially constant and making a discharge amount of the droplet changeable in accordance with a timing difference of driving timing, said timing difference being in a range enabling the discharged droplet to be formed as one dot on a surface of said recording medium.

16. A liquid discharge method for discharging liquid in a different discharge amount by use of a liquid discharge head provided with a liquid discharge nozzle for discharging liquid by a bubble created by a plurality of electrothermal converting members, comprising the step of:

differentiating a driving timing for driving any one of said plurality of electrothermal converting members to create a resultant liquid velocity that does not have a component in a discharge direction of the nozzle, the resultant liquid velocity being generated by the bubble created by said electrothermal converting member at a time on the discharge port.

17. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the step of:

discharging ink by setting a timing of driving a second of said electrothermal converting members subsequent to a first of said electrothermal converting members so that the second electrothermal converting member is driven during a period in which a meniscus of ink supplied in said nozzle is in a position that is retracted from a discharging end of said nozzle.

18. A liquid discharge method for a liquid discharge head according to claim 17, wherein ink is discharged by controlling said timing in accordance with gradational information contained in said recording signal for the formation of pixels having different ink amounts.

19. A liquid discharge method for a liquid discharge head according to claim 17, wherein said electrothermal converting member driven earlier is arranged on said opening edge side of said nozzle, and said electrothermal converting member driven later is arranged on the rear side of said nozzle.

20. A liquid discharge method for a liquid discharge head according to claim 19, wherein said electrothermal converting member driven earlier is comparatively smaller, and said electrothermal converting member driven later is comparatively larger.

21. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the step of:

discharging ink by setting a timing of driving a second of said electrothermal converting members subsequent to a first of said electrothermal converting members so that the second electrothermal converting member is driven during a period in which a meniscus of ink supplied in said nozzle is in a position that is retracted from a discharging end of said nozzle, wherein said timing is delayed relatively, during the period in which said meniscus of ink supplied in the nozzle is in the position retracted from the discharging edge of said nozzle, for the formation of pixel having a larger amount of ink.

22. A liquid discharge method for a liquid discharge head using a nozzle provided with at least two electrothermal converting members in interior of said nozzle for discharging ink from said nozzle by driving said electrothermal converting members in accordance with a recording signal for recording one pixel, comprising the steps of:

forming a pixel having a smaller amount of ink by driving only one of the electrothermal converting members in said nozzle to discharge ink; and forming a pixel having a larger amount of ink by driving a first one of the two electrothermal converting members in said nozzle, and after that, driving a second one of said electrothermal converting members to discharge ink for the formation of pixel having a large amount of ink by by driving the second one of said electrothermal converting members during a period in which a meniscus of ink supplied in said nozzle is in a position that is retracted from a discharging edge of said nozzle.

23. A liquid discharge method for a liquid discharge head according to claim 22, wherein said electrothermal converting member driven earlier is arranged on said opening edge side of said nozzle, and said electrothermal converting member driven later is arranged on the rear side of said nozzle.

24. A liquid discharge method for a liquid discharge head according to claim 23, wherein said electrothermal converting member driven earlier is comparatively smaller, and said electrothermal converting member driven later is comparatively larger.

25. A liquid discharge apparatus using a nozzle provided with at least two electrothermal converting members in an interior of said nozzle for discharging ink from said nozzle by driving said electrothermal converting members in accordance with a recording signal for recording one pixel, comprising:

means for discharging ink by setting a timing of driving a second of said electrothermal converting members subsequent to a first of said electrothermal converting members so that the second electrothermal converting member is driven during a period in which a meniscus of ink supplied in said nozzle is in a position that is retracted from a discharging end of said nozzle.

26. A liquid discharge apparatus according to claim 25, wherein ink is discharged by controlling said timing in accordance with the gradational information contained in said recording signal for the formation of pixel having different ink amount.

27. A liquid discharge apparatus according to claim 25, wherein said electrothermal converting member driven earlier is arranged on said opening edge side of said nozzle, and said electrothermal converting member driven later is arranged on the rear side of said nozzle.

28. A liquid discharge apparatus according to claim 27, wherein said electrothermal converting member driven earlier is comparatively smaller, and said electrothermal converting member driven later is comparatively larger.

29. A liquid discharge apparatus using a nozzle provided with at least two electrothermal converting members in an interior of said nozzle for discharging ink from said nozzle by driving said electrothermal converting members in accordance with a recording signal for recording one pixel, comprising:

means for discharging ink by setting a timing of driving a second of said electrothermal converting members subsequent to a first of said electrothermal converting members so that the second electrothermal converting member is driven during a period in which a meniscus of ink supplied in said nozzle is in a position that is retracted from a discharging end of said nozzle, wherein said timing is delayed relatively during the period of said meniscus of ink supplied in the nozzle being present in the position retracted from the opening edge of said nozzle for the formation of pixels having a larger amount of ink.

30. A liquid discharge apparatus using a nozzle provided with at least two electrothermal converting members in an interior of said nozzle for discharging ink from said nozzle by driving said electrothermal converting members in accordance with a recording signal for recording one pixel, comprising:

a first driving means for forming a pixel having a smaller amount of ink by driving only a first one of the electrothermal converting members in said nozzle to discharge ink; and a second driving means for forming pixel a having a larger amount of ink by driving one of the two electrothermal converting members in said nozzle, and after that, driving a second one of said electrothermal converting members to discharge ink for the formation of pixel having a large amount of ink by driving the second one of said electrothermal converting members during a period in which a meniscus of ink supplied in said nozzle is in a position that is retracted from a discharging edge of said nozzle.

31. A liquid discharge apparatus according to claim 30, wherein said electrothermal converting member driven earlier is arranged on said opening edge side of said nozzle, and said electrothermal converting member driven later is arranged on the rear side of the same nozzle.

32. A liquid discharge apparatus according to claim 31, wherein said electrothermal converting member driven earlier is comparatively smaller, and said electrothermal converting member driven later is comparatively larger.

33. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the steps of:

driving a first one of said electrothermal converting members when recording one pixel; and driving a second one of said electrothermal converting members subsequent to said first one of of said electrothermal converting members at a timing that substantially minimizes an ink discharge amount.

34. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the steps of:

driving a first one of said electrothermal converting members when recording one pixel; and driving a second one of said electrothermal converting members subsequent to said one of them being driven at the timing creating bubble in ink by driving of said other one of the electrothermal converting members when the volume of the bubble created in ink by the driving of said one of the electrothermal converting members becomes maximum substantially.

35. A liquid discharge method for a liquid discharge head according to claim 33 or 34, wherein said electrothermal converting members are arranged in positions having different distances from the opening edge of said nozzle, respectively.

36. A liquid discharge method for a liquid discharge head according to claim 35, wherein said electrothermal converting member having the shorter distance from said opening edge is driven earlier, and after that, said electrothermal converting member having the longer distance from said opening edge is driven at said timing.

37. A liquid discharge method for a liquid discharge head according to claim 35, wherein said electrothermal converting member having the longer distance from said opening edge is driven earlier, and after that, said electrothermal converting member having the shorter distance from said opening edge is driven at said timing.

38. A liquid discharge method for a liquid discharge head according to claim 36, wherein said electrothermal converting member having the shorter distance from said opening edge has a smaller area than said electrothermal converting member having the longer distance from said opening edge.

39. A liquid discharge method for a liquid discharge head according to claim 36, wherein the areas of said electrothermal converting member having the shorter distance from said opening edge and said electrothermal converting member having the longer distance from said opening edge are the same.

40. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the steps of:

driving a first one of said electrothermal converting members when recording one pixel; and driving a second one of said electrothermal converting members subsequent to said first one of of said electrothermal converting members at a timing that substantially minimizes an ink discharge amount, wherein said electrothermal converting members are arranged in positions having different distances from the opening edge of said nozzle, respectively, and said electrothermal converting member having the shorter distance from said opening edge is provided with an area for the value of discharge speed v/discharge amount Vd of the individual ink discharge from said electrothermal converting member to be reduced as said distance is increased.

41. A liquid discharge apparatus using a nozzle provided with at least two electrothermal converting members in an interior of said nozzle for discharging ink from said nozzle by driving said electrothermal converting members for recording, comprising:

means for driving said electrothermal converting members when recording one pixel; and controlling means for driving one of said electrothermal converting members by said driving means, and setting the timing to drive the other one of said electrothermal converting members subsequently at the timing to make the ink discharge amount minimum substantially.

42. A liquid discharge apparatus using a nozzle provided with at least two electrothermal converting members in an interior of said nozzle for discharging ink from said nozzle by driving said electrothermal converting members for recording, comprising:

means for driving said electrothermal converting members when recording one pixel; and controlling means for driving one of said electrothermal converting members by said driving means, and setting the timing to drive the other one of said electrothermal converting members subsequently at the timing to create bubble in ink by the driving of said other one of the electrothermal converting members when the volume of the bubble created in ink by the driving of said one of the electrothermal converting members becomes maximum substantially.

43. A liquid discharge apparatus according to claim 41 or 42, wherein said electrothermal converting members are arranged in positions having different distances from the opening edge of said nozzle, respectively.

44. A liquid discharge apparatus according to claim 43, wherein said electrothermal converting member having the shorter distance from said opening edge is driven earlier, and after that, said electrothermal converting member having the longer distance from said opening edge is driven at said timing.

45. A liquid discharge apparatus according to claim 43, wherein said electrothermal converting member having the longer distance from said opening edge is driven earlier, and after that, said electrothermal converting member having the shorter distance from said opening edge is driven at said timing.

46. A liquid discharge apparatus according to claim 44, wherein said electrothermal converting member having the shorter distance from said opening edge has a smaller area than said electrothermal converting member having the longer distance from said opening edge.

47. A liquid discharge apparatus according to claim 44, wherein the areas of said electrothermal converting member having the shorter distance from said opening edge and said electrothermal converting member having the longer distance from said opening edge are the same.

48. A liquid discharge apparatus using a nozzle provided with at least two electrothermal converting members in an interior of said nozzle for discharging ink from said nozzle by driving said electrothermal converting members for recording, comprising:

means for driving said electrothermal converting members when recording one pixel; and controlling means for driving one of said electrothermal converting members by said driving means, and setting the timing to drive the other one of said electrothermal converting members subsequently at the timing to make the ink discharge amount minimum substantially, wherein said electrothermal converting members are arranged in positions having different distances from the opening edge of said nozzle, respectively, and said electrothermal converting member having the shorter distance from said opening edge is provided with an area for the value of discharge speed v/discharge amount Vd of the individual ink discharge from said electrothermal converting member to be reduced as said distance is increased.

49. A liquid discharge method for a liquid discharge head using a nozzle provided with at least two electrothermal converting members in an interior of said nozzle for discharging ink from said nozzle by driving said electrothermal converting members in accordance with a recording signal for recording one pixel, comprising the steps of:

driving a first one of said electrothermal converting members when recording one pixel; and driving a second one of said electrothermal converting members subsequent to said one of them being driven at the timing creating bubble in ink by driving of said other one of the electrothermal converting members when the volume of the bubble created in ink by the driving of said one of the electrothermal converting members becomes maximum substantially, wherein said electrothermal converting members are arranged in positions having different distances from the opening edge of said nozzle, respectively, and said electrothermal converting member having the shorter distance from said opening edge is provided with an area for the value of discharge speed v/discharge amount Vd of the individual ink discharge from said electrothermal converting member to be reduced as said distance is increased.

50. A liquid discharge apparatus using a nozzle provided with at least two electrothermal converting members in an interior of said nozzle for discharging ink from said nozzle by driving said electrothermal converting members for recording, comprising:

means for driving said electrothermal converting members when recording one pixel; and controlling means for driving one of said electrothermal converting members by said driving means, and setting the timing to drive the other one of said electrothermal converting members subsequently at the timing to create bubble in ink by the driving of said other one of the electrothermal converting members when the volume of the bubble created in ink by the driving of said one of the electrothermal converting members becomes maximum substantially, wherein said electrothermal converting members are arranged in positions having different distances from the opening edge of said nozzle, respectively, and said electrothermal converting member having the shorter distance from said opening edge is provided with an area for the value of discharge speed v/discharge amount Vd of the individual ink discharge from said electrothermal converting member to be reduced as said distance is increased.

* * * * *

UNITED STATES PATENT AND TRADEMARK OFFICE

CERTIFICATE OF CORRECTION

PATENT NO. : 6,375,309 B1
DATED : April 23, 2002
INVENTOR(S) : Yoichi Taneya et al.

It is certified that error appears in the above-identified patent and that said Letters Patent is hereby corrected as shown below:

Title page,
Item [56], FOREIGN PATENT DOCUMENTS,
"JP 8-169116 7/1986" should read -- JP 8-169116 7/1996 --; and
"JP 8-183180 7/1986" should read -- JP 8-183180 7/1996 --.

Item [57], ABSTRACT,
Line 4, "discharging a" should read -- discharging --.

Column 1,
Line 57, "speed-is" should read -- speed is --.

Column 2,
Line 30, "altogether" should read -- together --; and
Line 60, "droplet" should read -- droplets --.

Column 3,
Line 60, "the feature" should read -- a feature --.

Column 4,
Line 13, "the feature" should read -- another feature --;
Line 34, "bubble" should read -- a bubble -- and "by" should read -- by the --;
Line 51, "case." should read -- cases. --; and
Line 52, "case," should read -- cases, --.

Column 6,
Line 49, "invention" should read -- invention. --.

Column 8,
Line 30, "sphere" should read -- spherical --.

Column 9,
Line 36, "discharged" should read -- are discharged --.

Column 10,
Line 59, "when a" should read -- when --; and
Line 65, "different" should read -- different from --.

Column 11,
Line 23, "them" should read -- them is --; and
Line 57, "discharged-in" should read -- discharged in --.

UNITED STATES PATENT AND TRADEMARK OFFICE

CERTIFICATE OF CORRECTION

PATENT NO. : 6,375,309 B1
DATED : April 23, 2002
INVENTOR(S) : Yoichi Taneya et al.

It is certified that error appears in the above-identified patent and that said Letters Patent is hereby corrected as shown below:

Column 15,
Line 63, “fast.” should read -- fast, --; and
Line 64, “Therefore,” should read -- therefore, --.

Column 16,
Line 15, “and” should be deleted.

Column 17,
Line 10, “bubble” should read -- the bubble --; and
Line 59, “on” should be deleted.

Column 18,
Line 10, “cased” should read -- caused --; and
Line 41, “discharge” should read -- discharged --.

Column 19,
Line 15, “(father” should read -- (farther --.

Column 20,
Line 14, “increase” should read -- increased --; and
Line 21, “is” should read -- are --.

Column 21,
Line 4, “respectively,” should read -- respectively --; and
Line 42, “is” should read -- are --.

Column 23,
Line 12, “ink” should read -- inks --.

Column 24,
Line 6, “as may be such structure as” should read -- as such structure as may be --.

Column 25,
Lines 24 and 31, “claim 5” should read -- claim 6 --.

Column 28,
Line 20, “by by” should read -- by --;
Line 51, “pixel” should read -- pixels --; and
Line 52, “amount.” should read -- amounts. --.

UNITED STATES PATENT AND TRADEMARK OFFICE

CERTIFICATE OF CORRECTION

PATENT NO. : 6,375,309 B1
DATED : April 23, 2002
INVENTOR(S) : Yoichi Taneya et al.

It is certified that error appears in the above-identified patent and that said Letters Patent is hereby corrected as shown below:

Column 29,
Line 23, “pixel a” should read -- a pixel --;
Line 27, “pixel” should read -- a pixel --;
Line 51, “of of” should read -- of --; and
Line 65, “creating” should read -- to create -- and “bubble” should read -- a bubble --.

Column 30,
Line 40, “of of” should read -- of --.

Column 31,
Line 9, “bubble” should read -- a bubble --.

Column 32,
Line 41, “bubble” should read -- a bubble --.

Signed and Sealed this

First Day of April, 2003

JAMES E. ROGAN
*Director of the United States Patent and Trademark Office*